US010569397B2

(12) United States Patent
Arai et al.

(10) Patent No.: US 10,569,397 B2
(45) Date of Patent: Feb. 25, 2020

(54) SUCCESSIVE SCREW FASTENER

(71) Applicant: MURO CORPORATION, Utsunomiya (JP)

(72) Inventors: Kunihiro Arai, Utsunomiya (JP); Satoshi Mishima, Utsunomiya (JP)

(73) Assignee: MURO CORPORATION, Utsunomiya (JP)

( * ) Notice: Subject to any disclaimer, the term of this patent is extended or adjusted under 35 U.S.C. 154(b) by 340 days.

(21) Appl. No.: 15/496,722

(22) Filed: Apr. 25, 2017

(65) Prior Publication Data

US 2017/0312896 A1 Nov. 2, 2017

(30) Foreign Application Priority Data

Apr. 28, 2016 (JP) ..... 2016-090793

(51) Int. Cl.
*B25B 17/00* (2006.01)
*B25B 23/04* (2006.01)
(Continued)

(52) U.S. Cl.
CPC ..... *B25B 23/045* (2013.01); *B25B 21/00* (2013.01); *B25B 23/0064* (2013.01); *B26B 11/00* (2013.01)

(58) Field of Classification Search
USPC ..... 81/57.37, 432, 433, 434, 435
See application file for complete search history.

(56) References Cited

U.S. PATENT DOCUMENTS 3,021,882 A * 2/1962 Knoll ..... B25B 23/06 81/432
4,667,545 A 5/1987 Gould
(Continued)

FOREIGN PATENT DOCUMENTS

GB 642047 A 8/1950
GB 2309186 A 7/1997
(Continued)

OTHER PUBLICATIONS

English translation for JP3159016, Total of 21 pages.
(Continued)

*Primary Examiner* — Joseph J Hail
*Assistant Examiner* — Shantese L McDonald
(74) *Attorney, Agent, or Firm* — R. Lynette Wylie; Apex Juris, PLLC.

(57) ABSTRACT

The present invention provides a successive screw fastener which enhances a screw fastening function and improves operability and rapidness of each element.

A successive screw fastener 1 according to the present invention has: a grip unit 2 including a trigger switch 16 with a direction lever 17 which sets a direction of forward rotation or reverse rotation of a rotary drive section 22 which rotationally drives a bit B; a screw fastener main body unit 3 including a gap adjustment mechanism section 91 which assuredly guides a screw S to a fastening acting position, a screw feed mechanism section 61 which avoids interference of the screw S and the bit B, a screw guide position adjustment mechanism section 101 which can simply adjust a gap between the fastening acting position and a fastening target position, and a magazine mounting mechanism section 111 having rigidity; a magazine unit 4 which can be easily attached to or detached from the screw fastener main body unit 3; and a handle unit 5 having excellent operability of an operator

.

21 Claims, 36 Drawing Sheets

(51) Int. Cl.

| | |
|---|---|
| ***B25B 21/00*** | (2006.01) |
| ***B25B 23/00*** | (2006.01) |
| ***B26B 11/00*** | (2006.01) |

(56) References Cited

U.S. PATENT DOCUMENTS

| | | | | |
|---|---|---|---|---|
| 5,186,085 | A | 2/1993 | Monacelli | |
| 6,109,144 | A * | 8/2000 | Muro | B25B 23/045 81/434 |
| 7,172,103 | B2 | 2/2007 | Fujiyama et al. | |
| 7,415,910 | B2 * | 8/2008 | Arai | B25B 23/04 81/433 |
| 2005/0017050 | A1 | 1/2005 | Fujiyama et al. | |
| 2006/0053978 | A1 | 3/2006 | Arai | |
| 2016/0032591 | A1 | 2/2016 | Arai et al. | |

FOREIGN PATENT DOCUMENTS

| | | | |
|---|---|---|---|
| JP | 51-15278 | U1 | 7/1974 |
| JP | 57-107782 | A | 7/1982 |
| JP | 9-136269 | A | 5/1997 |
| JP | 3159016 | B | 4/2001 |
| JP | 2003-175475 | A | 6/2003 |
| JP | 2006-82184 | A | 3/2006 |

OTHER PUBLICATIONS

EP Search Report for EP17165470.0, dated Oct. 17, 2017, Total of 6 pages.

EP Communication under Rule 71(3) EPC for EP17165470.0, dated Jun. 28, 2019, Total of 94 pages.

Japanese Office Action for JP2016-090793, dated Jul. 2, 2019, Total of 3 pages.

Response to Extended European Search Report for EP17165470.0 including amended claims, dated May 10, 2018, Total of 13 pages.

* cited by examiner

SUCCESSIVE SCREW FASTENER

TECHNICAL FIELD

The present invention relates to a successive screw fastener, and more particularly to a successive screw fastener which easily and rapidly fastens screws in a successive manner to fix a plate material, e.g., a wooden plate or a metal plate on a floor surface or a wall surface.

BACKGROUND ART

To fix a plate material, e.g., a wooden plate or a metal plate on a floor surface or a wall surface, a successive screw fastener which can successively fasten screws has been conventionally suggested.

The present applicant has suggested a successive screw fastener of this kind in advance and received a patent (Patent Literature 1).

In the successive screw fastener according to this Patent Literature 1, a driver is arranged at a position in front of a grip handle, a screw fastening bit is coupled with the driver through a deceleration mechanism to constitute a fastener main body so that the bit becomes detachable/attachable at a position above the driver, a screw feed mechanism main body is disposed to a front portion of the fastener main body to be slidable in a front-and-back direction, the bit is rotatably inserted into the screw feed mechanism main body, an adjuster ring formed into a substantially tubular shape on the fastener main body to adjust a screw fastening depth of the bit is inserted into the bit, a screw feed mechanism which sequentially feeds each screw in a screw rope having many screws disposed on a strip-like member in a parallel state toward a fastening acting position of the bit in tandem with sliding of the screw feed mechanism main body in the front-and-back direction which is associated with a fastening operation of the bit is constituted in the screw feed mechanism main body, a plurality of head grooves of the screws are formed in the screw feed mechanism main body to be parallel to a screw rope feed direction, a position of a guide path of the strip-like member of the screw rope in the front-and-back direction can be freely changed by changing a screw rope guide rising wall portion formed into an inverted-L-like shape between front and rear positions, a tip block having a protruding abutting surface is constituted on the screw feed mechanism main body so that it can be fixed at a desired position in the front-and-back direction of the screw feed mechanism main body, and a magazine which accommodates the screw rope is detachably disposed to the tip block.

CITATION LIST

Patent Literature

Patent Literature 1: Japanese Patent No. 3159016

SUMMARY OF INVENTION

Problem to be Solved by the Invention

The present invention realizes and provides a successive screw fastener which is based on technologies of the successive screw fastener according to Patent Literature 1, further enhances a screw fastening function as a whole by making various improvements, e.g., assuredness of screw feeding or simplification of unloading properties of a screw rope in a screw fastener main body unit, speediness, assuredness of operations of a grip unit, facilitation of attachment/detachment of a magazine unit, simplification of attachment/detachment of a lid body to/from a magazine main body, improvement in operability of a detachably configured handle unit when the handle unit is attached and used, and others, and also improves rapidity and operability.

Means for Solving Problem

The present invention is mainly characterized by providing a successive screw fastener including: a grip unit which has a screw fastening bit arranged to protrude and rotationally drives the bit by a switch operation and a clutch; a screw fastener main body unit which is arranged below the grip unit, supports the grip unit to be upwardly and downwardly movable, arranges a tip of the bit to face a fastening acting position, and fastens the screw at a fastening target position on a lower side; a magazine unit which is detachably disposed to the screw fastener main body unit, accommodates a screw rope holding many screws at predetermined intervals, and expels the screw rope toward the screw fastener main body unit; and a handle unit which is detachably disposed to an upper portion of the grip unit to enable adjustment of a protruding height to the grip unit, the successive screw fastener being configured to sequentially guide the respective screws held by the screw rope to the fastening acting position below a tip of the bit in tandem with a rising operation of the grip unit, and successively fasten the respective screws to the fastening target position below the screw fastener main body unit by using rotational force of the bit in tandem with a lowering operation of the grip unit in a rotating state of the bit, where the grip unit is configured to include a trigger switch having a direction lever which sets forward rotation and reverse rotation directions of a rotary drive section which rotationally drives the bit, the screw fastener main body unit includes: a gap adjustment mechanism section which changes a gap between a feeder block which guides the screw held by the screw rope to the fastening acting position and a guide cover arranged to face the feeder block on the basis of translation adjustment of the guide cover; a screw feed mechanism section which enables feeding the screws to the fastening acting position one by one while avoiding interference between a head portion of each screw and the tip of the bit, and enables taking out the screw held by the screw rope from the fastening acting position by an operation of an operator; a screw guide position adjustment mechanism section which is arranged at a lower end portion of the screw fastener main body unit and adjusts a position of a screw guide arranged to abut on the fastening target position; and a magazine mounting mechanism section having rigidity which is provided on a rear portion side of the screw fastener main body unit, the magazine unit includes a magazine main body which accommodates and expels the screw rope and a lid body which covers the magazine main body, the magazine main body is configured to be attachable to and detachable from the screw fastener main body unit by using elastic force of a spring plate which is arranged in the magazine main body and has spring properties, and the handle unit is configured to enable easily adjusting a protruding length of the grip unit from the handle grip to be long or short by a double structure consisting of an outer shaft and an inner shaft when the handle unit is attached to an upper portion of the grip unit to be used.

Effect of the Invention

According to the invention of claim 1, it is possible to realize and provide the successive screw fastener which improves assuredness of screw feeding or simplification of unloading properties of the screw slope in the screw fastener main body, assuredness of a screw rotational drive operation using the grip unit, facilitation of attachment/detachment of the magazine unit, and simplification of attachment/detachment of the lid body to/from the magazine main body, enhances the operability, upgrades the screw fastening function as a whole, and improves the operation, the operability, and the rapidness of each element.

Further, according to the invention of claim 2 and claim 3, it is possible to realize and provide the successive screw fastener which improves assuredness of screw feeding or simplification of unloading properties of the screw slope in the screw fastener main body, assuredness of a screw rotational drive operation using the grip unit, facilitation of attachment/detachment of the magazine unit, simplification of attachment/detachment of the lid body to/from the magazine main body, and the operability of the handle unit by an operator, upgrades the screw fastening function as a whole, and improves the operation, the operability, and the rapidness of each element.

Furthermore, according to the invention of claim 2 and claim 3, when the handle unit has a double structure consisting of the outer shaft and the inner shaft, namely, when it specifically has a configuration in which the outer shaft enters the grip unit, a projecting length of the handle grip from the grip unit, i.e., a length range of length adjustment can be enlarged. Although several types of length settings are required in this type of prior devices, these functions and effects can be realized with the single setting in the configuration of the present invention. As regards fixation of the length adjustment, looseness occurs and a length changes since a simple pinching structure is adopted in this type of prior art devices, but the configuration of the present invention can realize and provide the successive screw fastener which can eliminate this change by just inserting the pin into the recess.

According to the invention of claim 4, since the successive screw fastener according to any one of claims 1 to 3 includes the screw rope cutter which cuts the empty screw rope discharged from the screw fastener main body unit, it is possible to realize and provide the successive screw fastener which extremely facilitate removal of the empty screw rope.

According to the invention of claim 5, in the successive screw fastener according to any one of claims 1 to 4, since the handle unit is inserted into the smooth handle unit insertion opening provided in the upper surface portion of the grip unit and fixed to the grip unit by the handle unit lock lever provided in the grip unit, it is possible to realize and provide the successive screw fastener which has improved the safety in the upper surface portion of the grip unit having no handle unit disposed thereto.

According to the invention of claim 6, in the successive screw fastener according to any one of claims 1 to 5, the lid body shaft support portion having a pair of pin holes is provided in the magazine main body of the magazine unit, the lid body can be attached to or detached from the lid body shaft support portion by engaging or disengaging a pair of pins provided to a pair of pin support plates which are provided on the lid body and whose tip sides move closer to or away from each other by a manual operation with or from the pair of pin holes of the lid body shaft support portion, and hence it is possible to realize and provide the successive screw fastener which extremely facilitates attachment or detachment of the lid body to or from the magazine main body.

BEST MODE(S) FOR CARRYING OUT THE INVENTION

Figure 1:
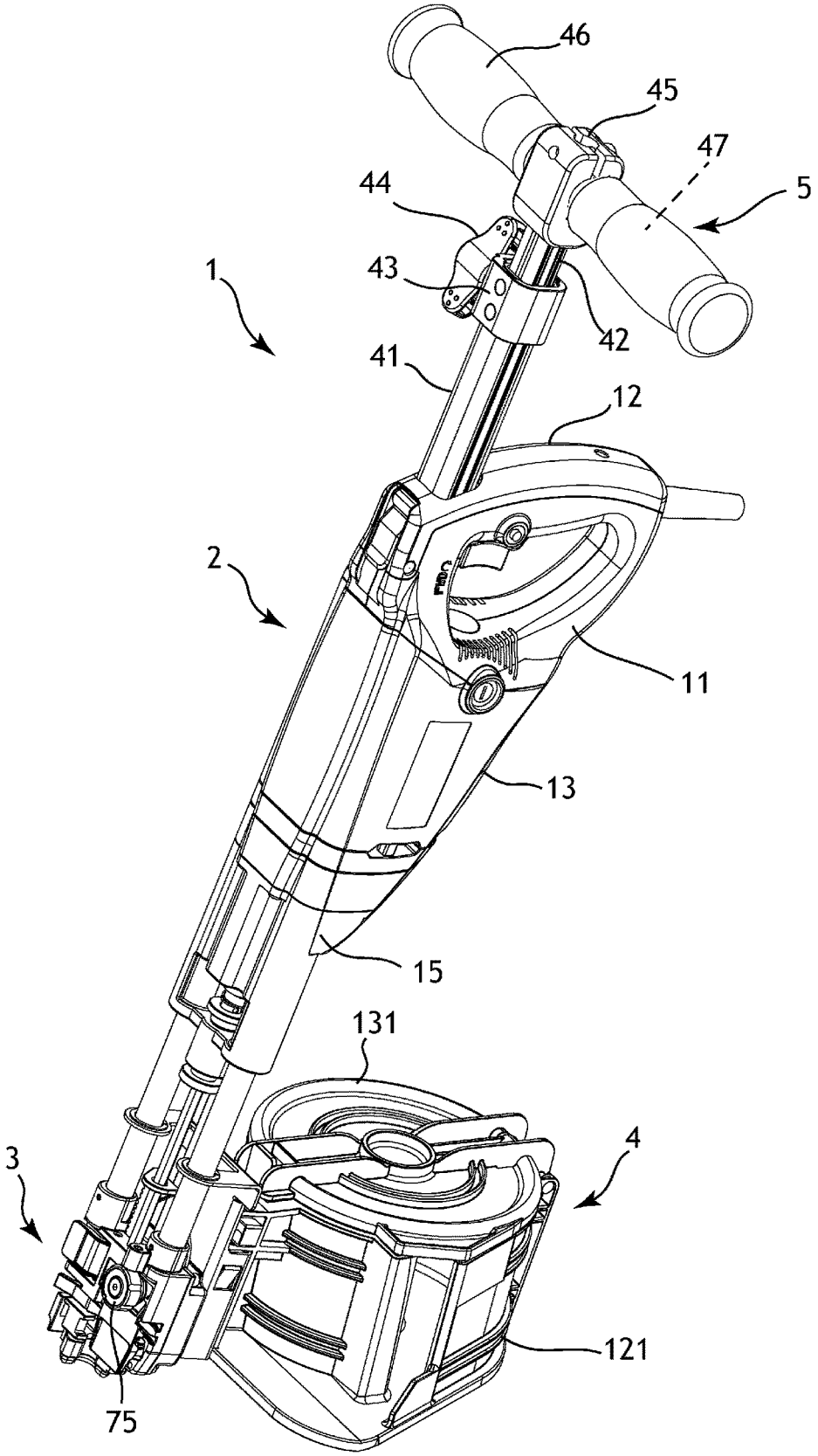
FIG. 1 is a schematic perspective view showing an entire configuration of a successive screw fastener according to an example of the present invention.

According to the present invention, the object of making various improvements, e.g., assuredness of screw feeding or simplification of unloading of a screw rope in a screw fastener main body unit, assuredness of an operation of a grip unit, facilitation of attachment/detachment of a magazine unit, simplification of attachment/detachment of a lid body to/from a magazine main body, or enhancement of operability of a detachably configured handle unit in case of using the handle unit in the attached state to realize and provide a successive screw fastener which has upgraded a screw fastening function as a whole and improved the operability and rapidness is realized by configuring the successive screw fastener including: a grip unit which has a screw fastening bit arranged to protrude and rotationally drives the bit by a switch operation and a clutch; a screw fastener main body unit which is arranged below the grip unit, supports the grip unit to be upwardly and downwardly movable, arranges a tip of the bit to face a fastening acting position, and fastens the screw at a fastening target position on a lower side; a magazine unit which is detachably disposed to the screw fastener main body unit, accommodates a screw rope holding many screws at predetermined intervals, and expels the screw rope toward the screw fastener main body unit; and a handle unit which is detachably disposed to an upper portion of the grip unit to enable adjustment of a protruding height to the grip unit, the successive screw fastener being configured to sequentially guide the respective screws held by the screw rope to the fastening acting position below a tip of the bit in tandem with a rising operation of the grip unit, and successively fasten the respective screws to the fastening target position below the screw fastener main body unit by using rotational force of the bit in tandem with a lowering operation of the grip unit in a rotating state of the bit, where the grip unit is configured to include a trigger switch having a direction lever which sets forward rotation and reverse rotation directions of a rotary drive section which rotationally drives the bit, the screw fastener main body unit includes: a gap adjustment mechanism section which changes a gap between a feeder block which guides the screw held by the screw rope to the fastening acting position and a guide cover arranged to face the feeder block on the basis of translation adjustment of the guide cover; a screw feed mechanism section which comprises a feed lever operation body interlocked with lowering and rising of the grip unit, a feed lever which operates in response to lowering and rising of the feed lever operation body, a feed latch for screw feeding turnably supported by the feed lever, a turnable grip finger which locks the screw to face a fastening acting position, and a release lever which constitutes a single link structure interlocked with the feed latch and the grip finger, enables feeding the screws to the fastening acting position one by one while avoiding interference between a head portion of each screw and the tip of the bit, and interlocks the grip finger and the feed latch via the release lever to enable taking out the screw held by the screw rope from the fastening acting position by an operation of an operator; a screw guide position adjustment mechanism section which is arranged at a lower end portion of the screw fastener main body unit and adjusts a position of a screw guide arranged to abut on the fastening target position; and a magazine mounting mechanism section having rigidity which is provided on a rear portion side of the screw fastener main body unit, the magazine unit includes a magazine main body which accommodates and expels the screw rope and a lid body which covers the magazine main body, the magazine main body being configured to be attachable to and detachable from the screw fastener main body unit by using elastic force of a spring plate having spring properties which is arranged in a magazine mounting mechanism section provided in the screw fastener main body unit, the lid body being configured to be attachable to and detachable from a lid body shaft support portion of the magazine main body by pin coupling, and the handle unit has a double structure consisting of an outer shaft and an inner shaft, the outer shaft being configured to be locked to the grip unit, the inner shaft being configured to enable adjusting its position to the outer shaft and configured to be locked, and a protruding length of a handle grip from the grip unit being adjustable to be increased or reduced.

EXAMPLES

A successive screw fastener according to an example of the present invention will now be described hereinafter in detail with reference to the respective drawings.

As shown in FIG. 1, a successive screw fastener 1 according to this example has a grip unit 2 which is held in one hand of an operator of this successive screw fastener 1 and rotationally drives a bit B protruding downwards to fasten a screw S at a target position, a screw fastener main body unit 3 which is arranged below the grip unit 2 and uses rotational force provided by the bit B to fasten the screw S at the target position, a magazine unit 4 which is detachably arranged at the back of the screw fastener main body unit 3 and successively supplies the screw S to this screw fastener main body unit 3, and a handle unit 5 which is arranged above the grip unit 2, configured to be insertable/removable into/from the grip unit 2 so that its height can be adjusted, and held and operated with both hands (or one hand) of the operator of the successive screw fastener 1.

In the present invention, the handle unit 5 is not an indispensable constituent. The handle unit 5 is detachably configured above the grip unit 2. At the time of using the successive screw fastener 1 according to this example, it can be used with the handle unit 5 or without the handle unit 5.

The bit B is a member corresponding to a driver as a general tool, and formed of a shaft having a hexagonal cross section. At each of both ends of this bit B, an engagement convex portion which engages with a head portion of a screw, e.g., an engagement groove such as a cross groove is formed, and a meshing groove is formed near this engagement convex portion along a circumferential direction.

An appearance constitution of the grip unit 2 will now be described with reference to FIG. 1 and FIG. 2.

The grip unit 2 has a handle cover 11 constituted of front and back sides forming a space into which one hand of an operator is inserted for gripping, an end cover 12 which covers an upper portion of this handle cover 11, a tubular housing 13 arranged below the handle cover 11, a lower first cover 14*a* and a lower second cover 14*b* which are sequentially attached to a lower side of this housing 13, and a block head 15 which is further attached to a lower side of the lower second cover 14*b*.

On a lower surface side of the end cover 12, a trigger switch 16 configured to start rotation or stop rotation of a later-described rotary drive source 23 is arranged, and a direction lever 17 configured to rotate the rotary drive source 23 in a forward or reverse direction is disposed next to the trigger switch 16.

The trigger switch 16 and the direction lever 17 are integrally configured to prevent accidental switching between forward rotation and reverse rotation.

Further, a handle unit insertion opening 18 into which a lower end side of the handle unit 5 is inserted and which has no irregularities on a surface thereof is provided on a front portion side of the end cover 12, and a handle unit lock lever 19 which fixes the handle unit 5 to the grip unit 2 itself or unfixes the same is arranged on a front portion of the handle cover 11.

That is, an insertion space for the handle unit 5 extending from the handle unit insertion opening 18 to the inside of the housing 13 is formed in the end cover 12, the handle cover 11, and the housing 13 of the grip unit 2, and an outer shaft 41 part of the handle unit 5 inserted from the handle unit insertion opening 18 is configured to prevent a handle grip 46 from coming off the grip unit 2 by inserting the outer shaft 41 until its tip portion abuts on the lower first cover 14*a* and operating the handle unit lock lever 19 to fix the outer shaft 41.

The handle unit insertion opening 18 and the handle unit lock lever 19 will now be further described.

Figure 9:
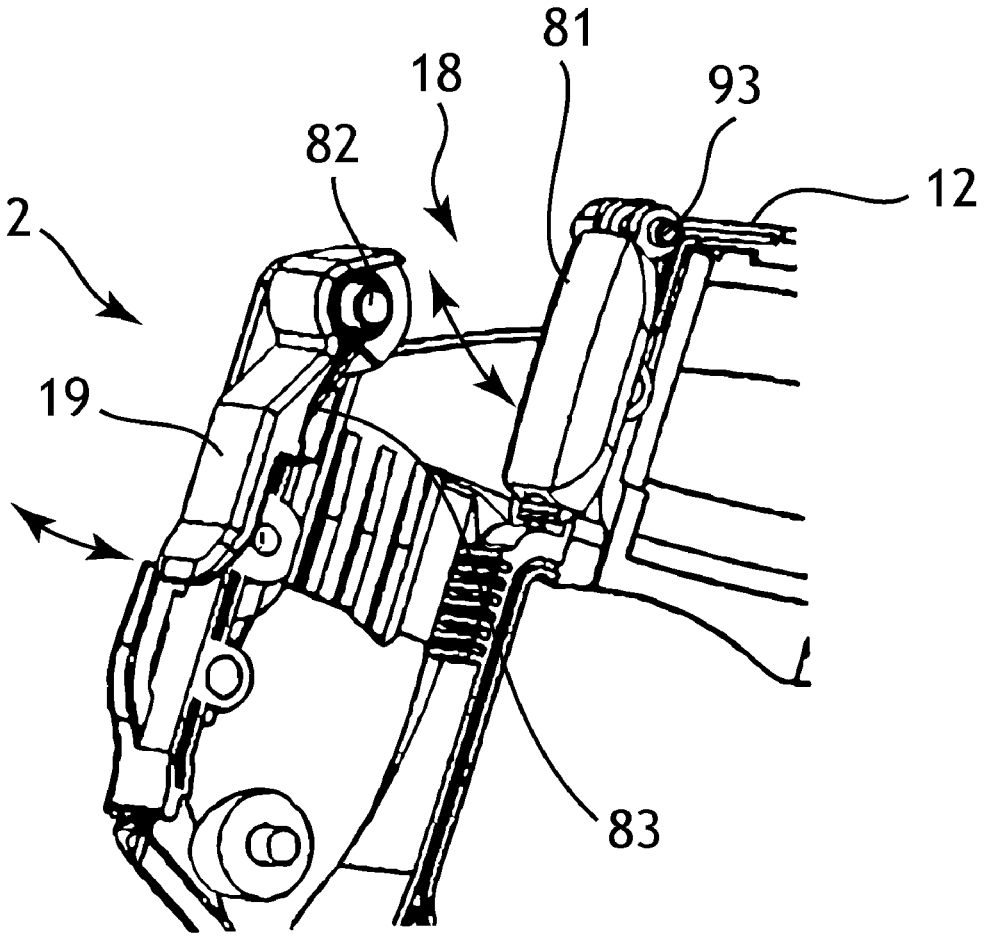
FIG. 9 is a partial perspective view showing a handle unit insertion opening and a handle unit lock lever in the grip unit according to this example.

In a region of the handle unit insertion opening 18 in the end cover 12, as shown in FIG. 9, a handle unit insertion opening cover 81 which fully closes or opens this handle unit insertion opening 18 is supported by a pin 93 so that it can be opened or closed, and the handle unit insertion opening cover 81 is energized toward the handle unit insertion opening 18 side by a spring (not shown) so that the handle unit insertion opening 18 can be constantly closed.

On the other hand, the handle unit lock lever 19 engages with a tip portion of the handle unit insertion opening cover 81 to provide a locked state where the handle unit insertion opening 18 is closed and, when the handle unit lock lever 19 is lifted up against elastic force of a lever spring 83, the handle unit insertion opening cover 81 is unlocked so that the handle unit 5 can be inserted into the grip unit 2 from the handle unit insertion opening 18.

Furthermore, when the handle unit lock lever 19 is put back in place, the handle unit insertion opening cover 81 can be again locked.

According to such a configuration, since the handle unit insertion opening cover 81 which closes the handle unit insertion opening 18 of the end cover 12 is not exposed to the outside from this handle unit insertion opening 18 and no irregularities are formed near the handle unit insertion opening 18, an inconvenience that a hand of an operator who operates the grip unit 2 is hit and damaged does not occur, and safety can be improved.

Figure 30:
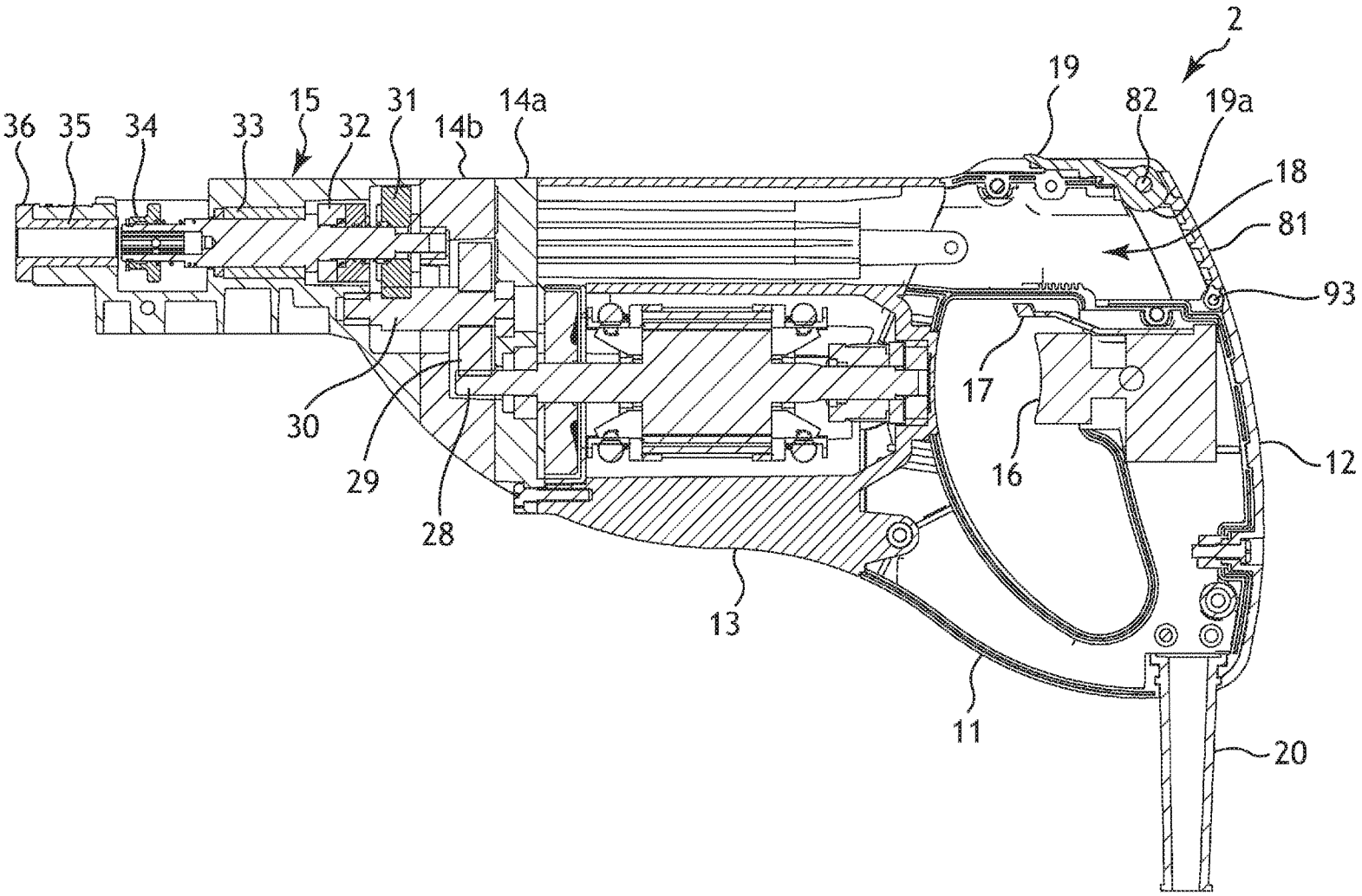
FIG. 30 is an explanatory drawing showing a fixing mechanism of a handle unit according to this example.
Figure 31:
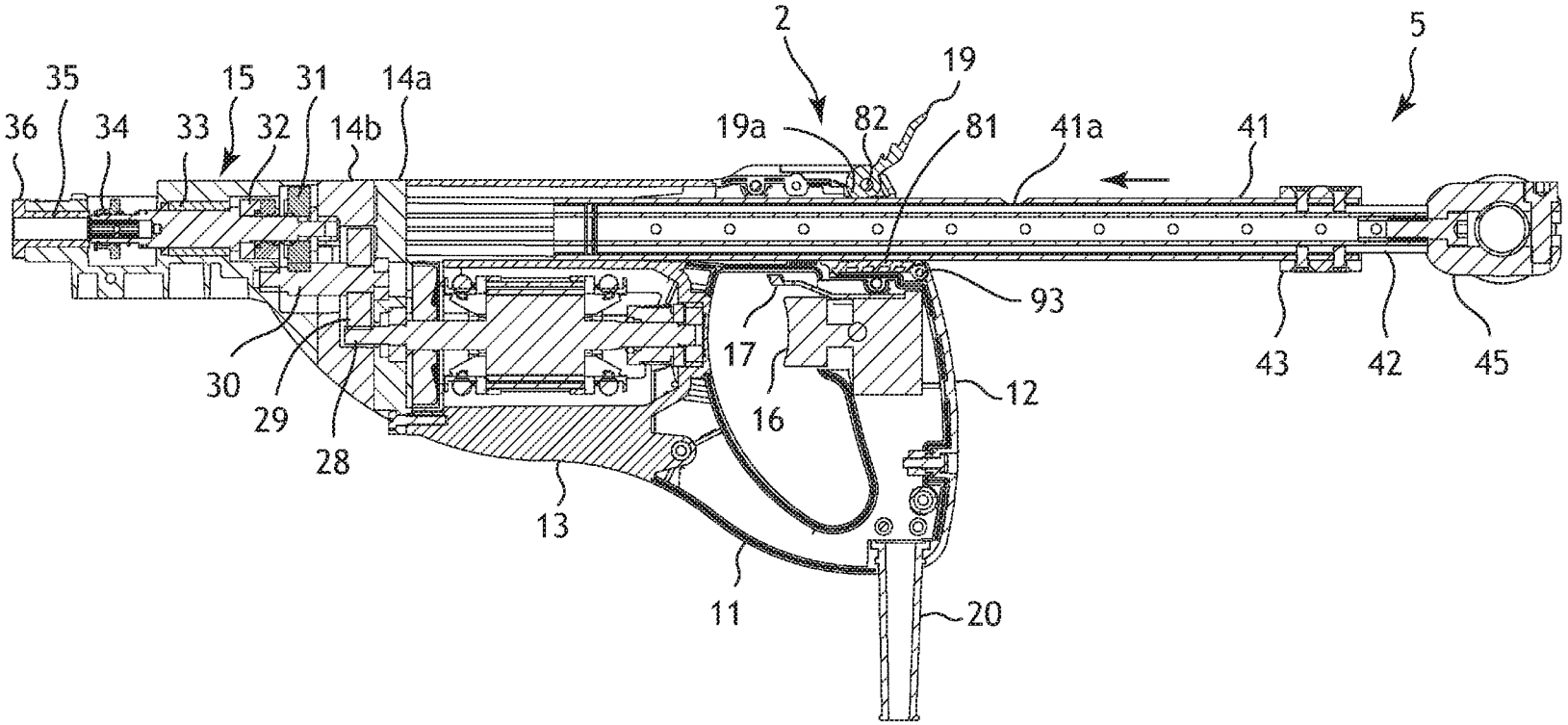
FIG. 31 is an explanatory drawing showing the fixing mechanism of the handle unit according to this example.
Figure 32:
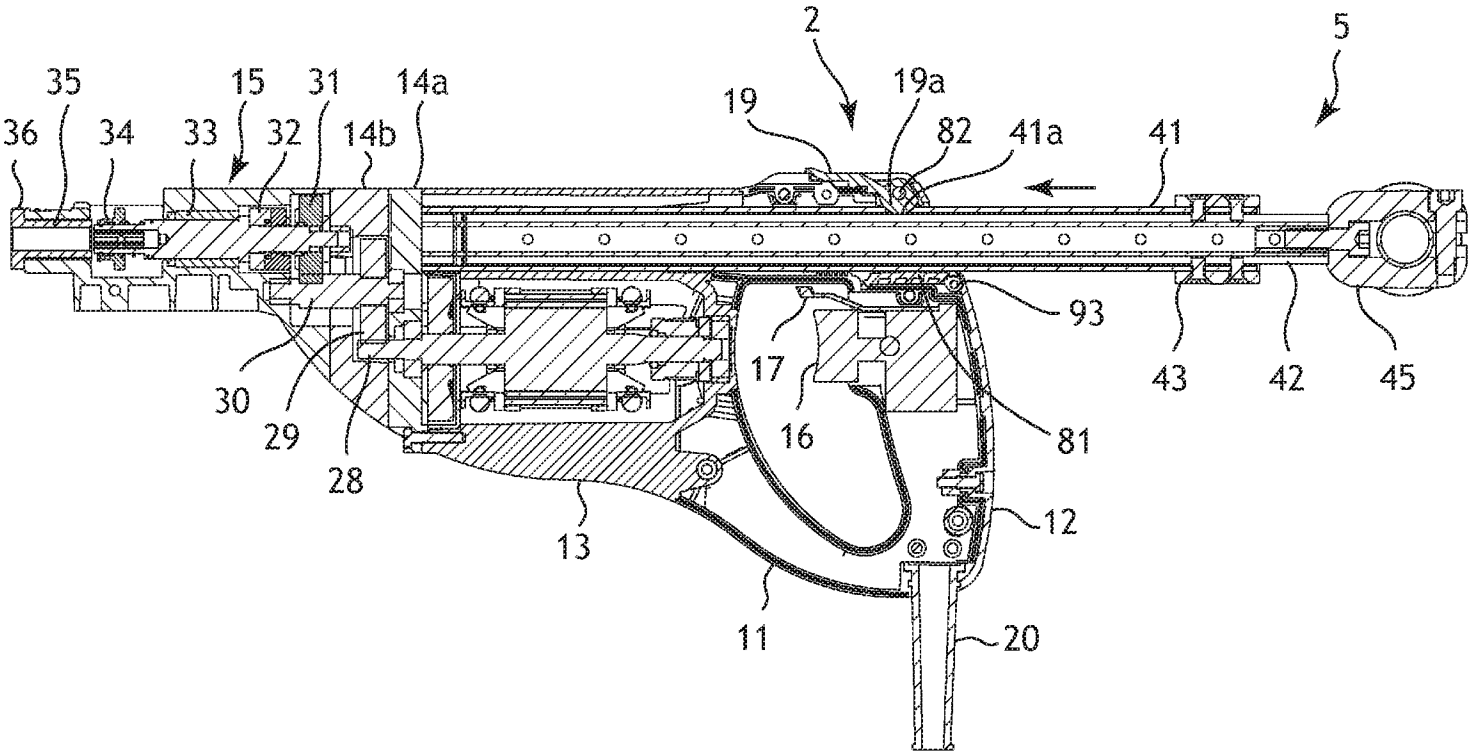
FIG. 32 is an explanatory drawing showing the fixing mechanism of the handle unit according to this example.

FIG. 30 to FIG. 32 are explanatory drawings each showing a fixing mechanism of the handle unit 5.

FIG. 30 shows a state before inserting the shaft portion of the handle unit 5, and the handle unit insertion opening cover 81 is fixed without being opened to the inside (it is not opened to the outside) by a cam portion 19*a* of the handle unit lock lever 19. In this state, when the handle unit lock lever 19 is raised, fixation of the handle unit insertion opening cover 81 is canceled so that this member can be inwardly pushed down, and the shaft portion of the handle unit 5 can be inserted.

FIG. 31 shows a state during insertion of the shaft portion of the handle unit. In a state where the handle unit lock lever 19 is being raised, when the outer shaft 41 of the handle shaft is inserted while inwardly pushing down the handle unit insertion opening cover 81, and the raised state is maintained until a recess 41*a* on the outer shaft 41 reaches the cam portion 19*a* of the handle unit lock lever 19.

FIG. 32 shows a fixed state of the shaft portion of the handle unit. When a tip of the outer shaft 41 is inserted until it reaches the lower first cover and the recess 41*a* reaches the cam portion 19*a* of the handle unit lock lever 19, the handle unit lock lever 19 falls and the outer shaft 41 is fixed.

Figure 2:
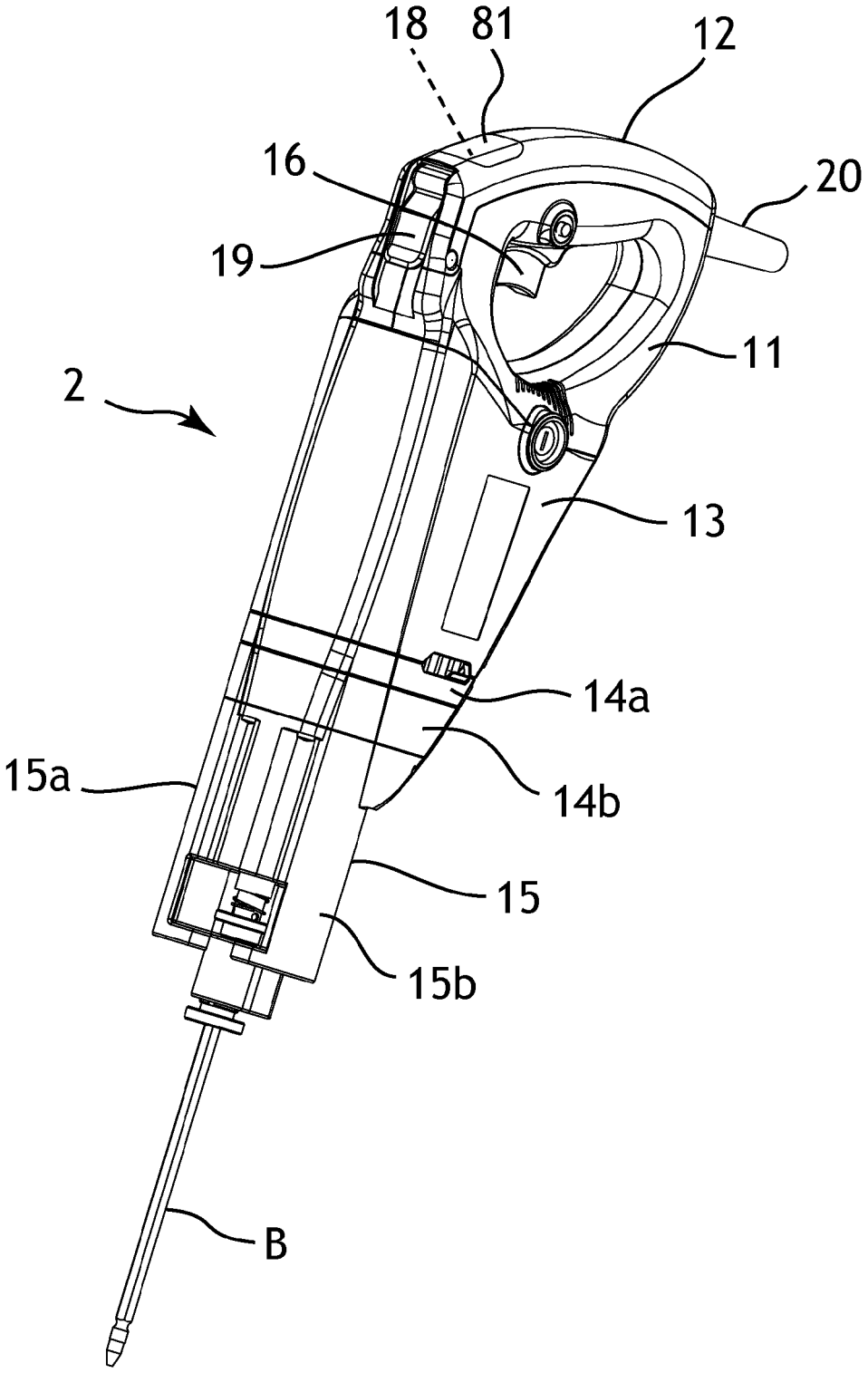
FIG. 2 is a schematic perspective view of a grip unit in the successive screw fastener according to this example.

At a rear portion of the end cover 12 of the grip unit 2, as shown in FIG. 2, a cord holding portion 20 configured to hold a power supply cord (not shown) for power supply which is required for an operation of the successive screw fastener 1 according to this example is disposed.

Figure 3:
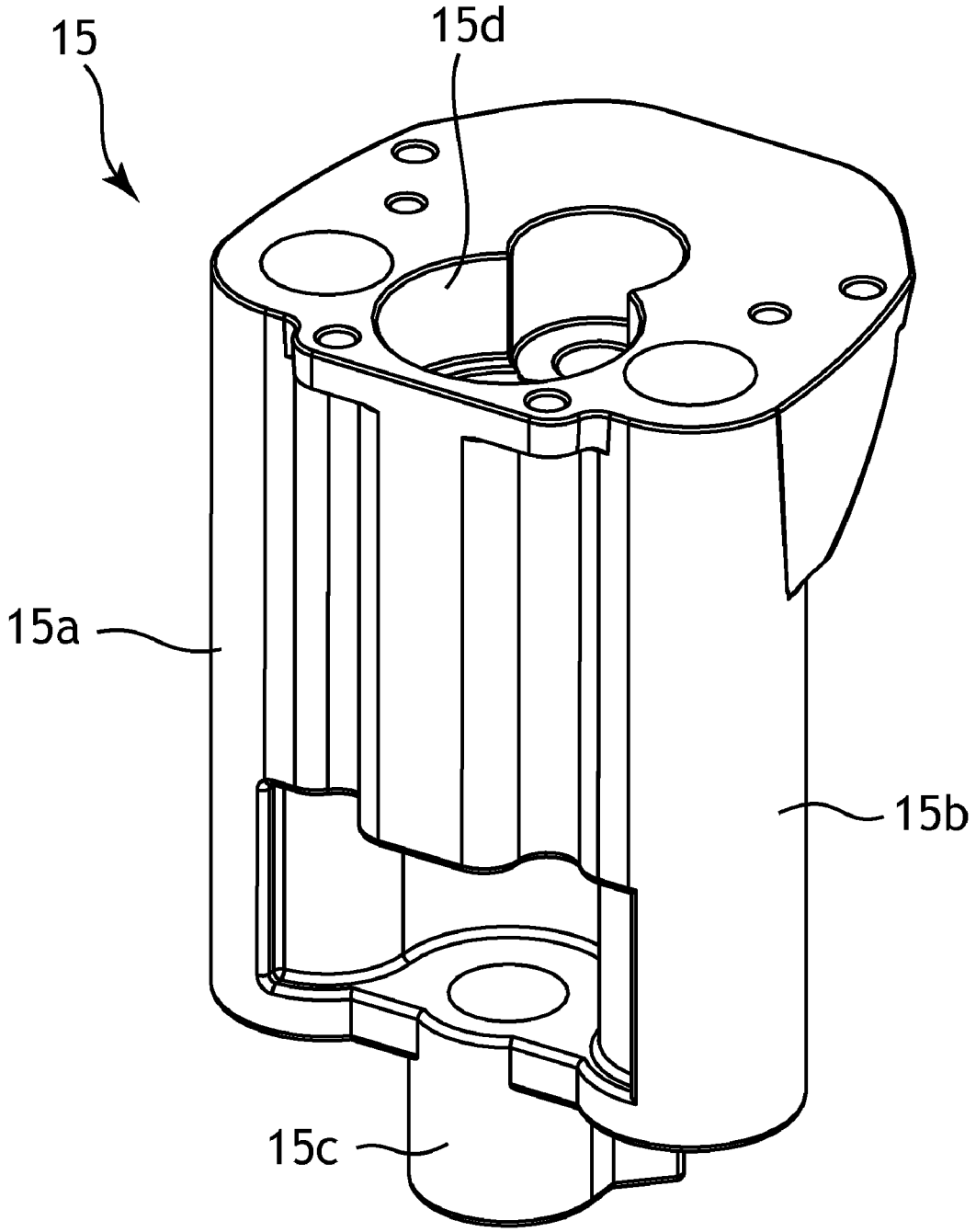
FIG. 3 is a schematic perspective view of a block head alone constituting the grip unit according to this example.

As shown in FIG. 3, the block head 15 includes, in a parallel configuration, a pair of left and right guide pole insertion tubes 15*a* and 15*b* which are attached to be movable vertically on outer peripheries of a pair of guide poles 21*a* and 21*b* which are interposed between the grip unit 2 and the screw fastener main body unit 3 and arranged in parallel, and a bit insertion tube 15*c* into which the bit B is inserted is provided in an intermediate portion of lower positions of the pair of guide pole insertion tubes 15*a* and 15*b*.

Moreover, the bit B whose upper end portion is held by the grip unit 2 is protruded downward in a state where it pierces through the bit insertion tube 15*c*, and a lower end side of this bit B faces the inside of the screw fastener main body unit 3.

Additionally, an accommodation hole 15*d* that accommodates a constituent element of a rotary drive section 22, which will be described later in detail, is formed from an upper surface side of the block head 15 to an upper position of the bit insertion tube 15*c*.

A configuration of the rotary drive unit 22 which rotationally drives the bit B in the grip unit 2 will now be generally described with reference to FIG. 4 and FIG. 5.

The rotary drive section 22 includes a rotary drive source 23 which rotates by an operation of the trigger switch 16, and a bit rotary drive mechanism section 24 which transmits rotational force of this rotary drive source 23 to the bit B.

Figure 5:
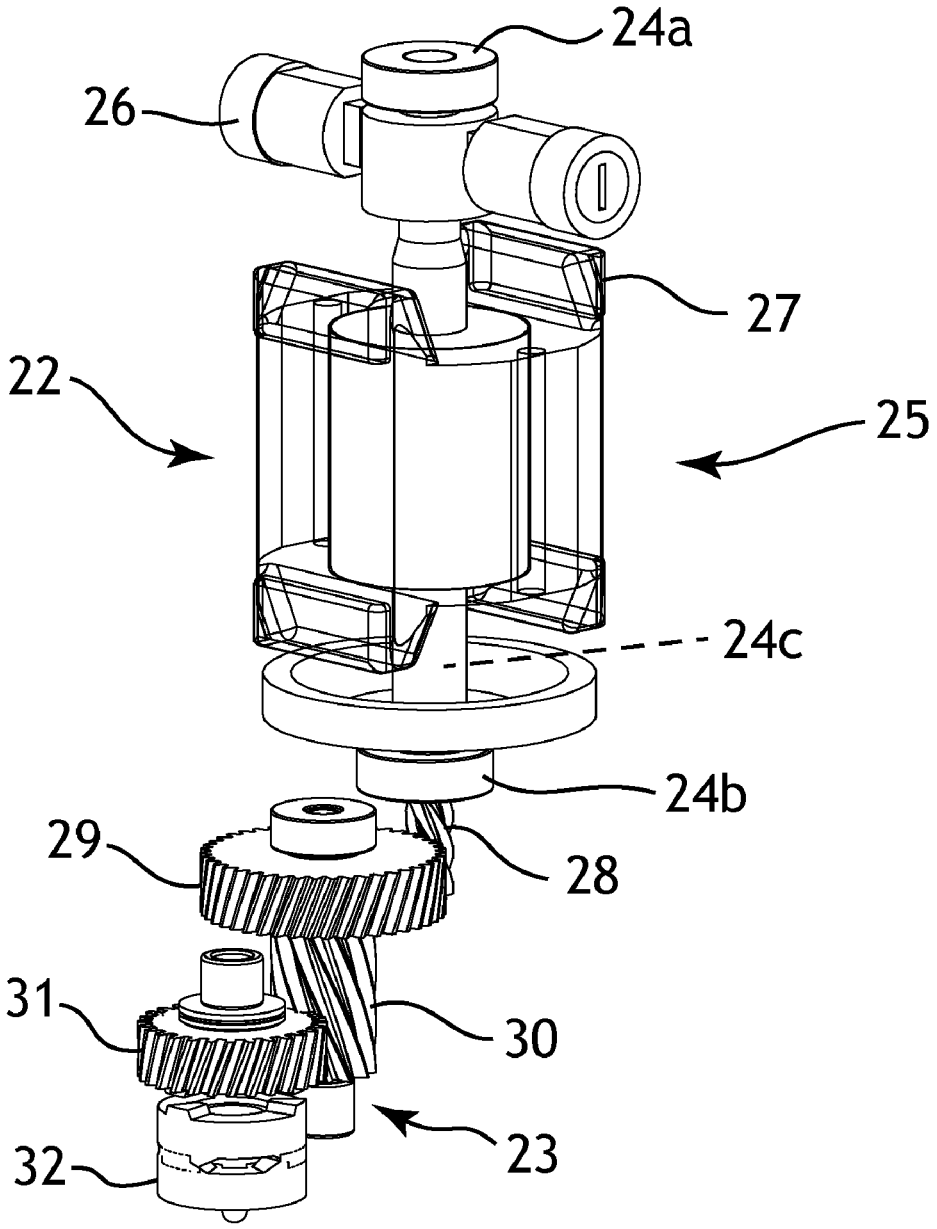
FIG. 5 is a schematic perspective view showing a rotary drive source and a gear group constituting the rotary drive section shown in FIG. 4.

As shown in FIG. 5 in an enlarging manner, the rotary drive source 23 includes a pair of bearings 24*a* and 24*b* which are fixed and arranged to vertically face each other in the grip unit 2, a drive motor 25 which rotates a driving shaft 24*c* rotationally supported by the pair of bearings 24*a* and 24*b* with a direct-current voltage and is configured to rotate in a forward or reverse direction by an operation of the direction lever 17, a brush 26 configured to apply the direct-current voltage to the drive motor 25, and a stator 27 arranged around the drive motor 25, and a first gear 28 constituting the bit rotary drive mechanism section 24 is disposed to a lower portion of the driving shaft 24*c*.

In this example, of the pair of bearings 24*a* and 24*b*, the bearing 24*a* is formed of a plastic housing, the bearing 24*b* is formed of an aluminum block, and they are fixed at predetermined positions in the grip unit 2 so that an accuracy and rigidity near the gear in the rotary drive section 22 are improved.

Figure 4:
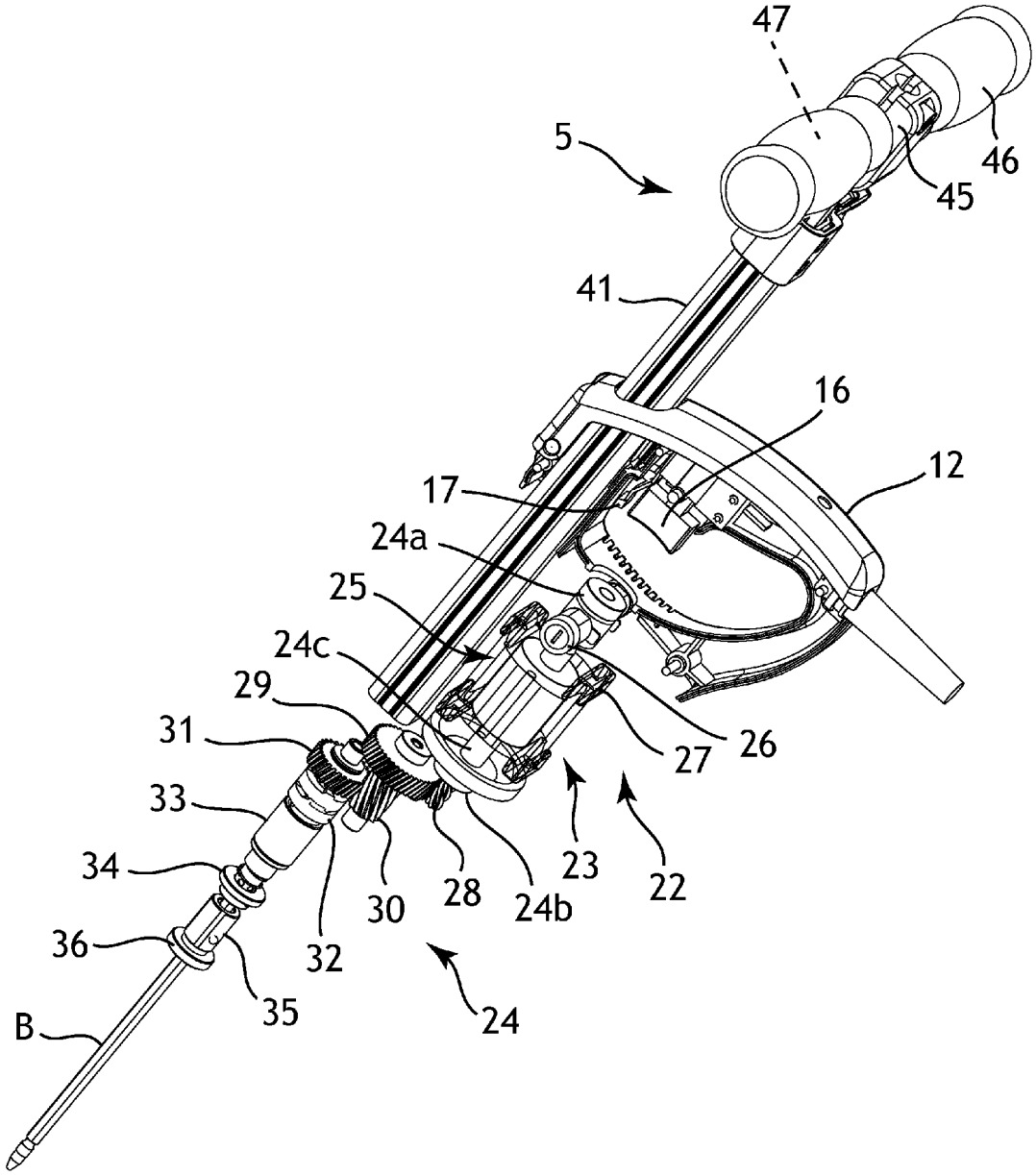
FIG. 4 is a schematic perspective view showing a rotary drive section and a handle unit arranged in the grip unit according to this example.

As shown in FIG. 4, the bit rotary drive mechanism section 24 includes the first gear 28, a second gear 29 and a third gear 30 which are coaxially arranged in the grip unit 2, a fourth gear 31 which is arranged coaxially with the bit B, a clutch 32, a bearing (a needle bearing) 33, a socket 34, a sleeve 35, and a bit adjustment dial 36 which holds an upper portion of the bit B and adjusts a bit fastening depth.

The clutch 32, the bearing 33, the socket 34, the sleeve 35, and the bit adjustment dial 36 are arranged coaxially with the bit B and the fourth gear 31.

Additionally, an outer peripheral portion of the bit adjustment dial 36 is exposed below the bit insertion tube 15*c* of the block head 15 so that it can be operated with an operator's fingers.

The bearing 24*b* of the pair of bearings 24*a* and 24*b* and bearings which support the second gear 29 and the third gear 30 are all fixed at predetermined positions in the grip unit 2 by using aluminum blocks so that the accuracy and the rigidity of the rotary drive section 22 can be improved.

The handle unit 5 will now be described.

As described above, in the present invention, the handle unit 5 is not an indispensable constituent, but the handle unit 5 is configured to be attachable/detachable to/from the upper portion of the grip unit 2. At the time of using the successive screw fastener 1 according to this example, the successive screw fastener 1 can be used with the handle unit 5 attached thereto or used without the handle unit 5 attached thereto.

Further, in case of using the successive screw fastener 1 with the detachably configured handle unit attached thereto, the operability of the handle unit can be improved. Specifically, as will be described later, when the handle unit has the double structure consisting of the outer shaft and the inner shaft, namely, when it specifically has a configuration in which the outer shaft enters the grip unit, a projecting length of the handle grip from the grip unit, i.e., a length range of length adjustment can be enlarged. Although several types of length settings are required in this type of prior devices, these functions and effects can be realized with the single setting in the configuration of the present invention. As regards fixation of the length adjustment, looseness occurs and a length changes since a simple pinching structure is adopted in this type of prior art devices, but the configuration of the present invention can realize and provide the successive screw fastener which can eliminate this change by just inserting the pin into the recess.

Figure 33:
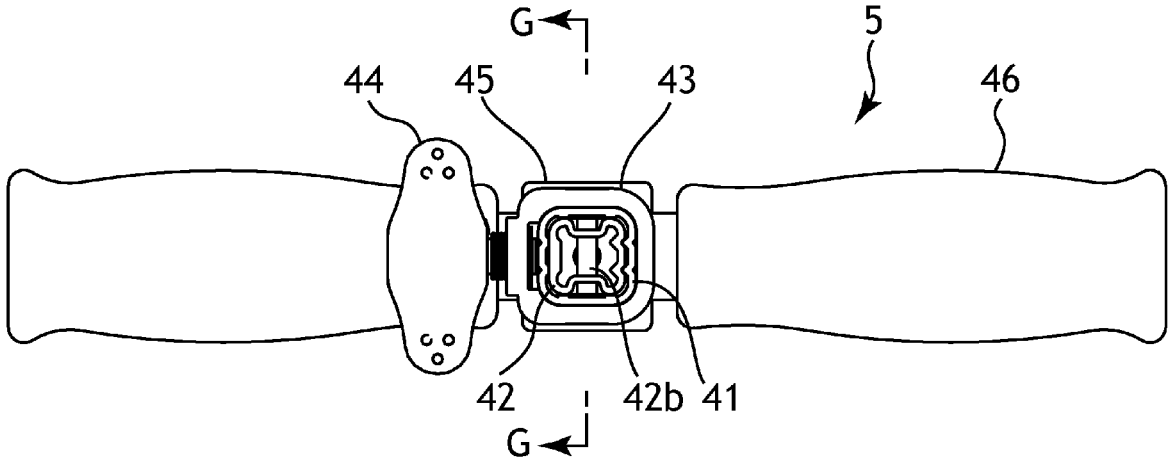
FIG. 33 is an explanatory drawing showing a retaining mechanism of the handle unit according to this example.
Figure 34:
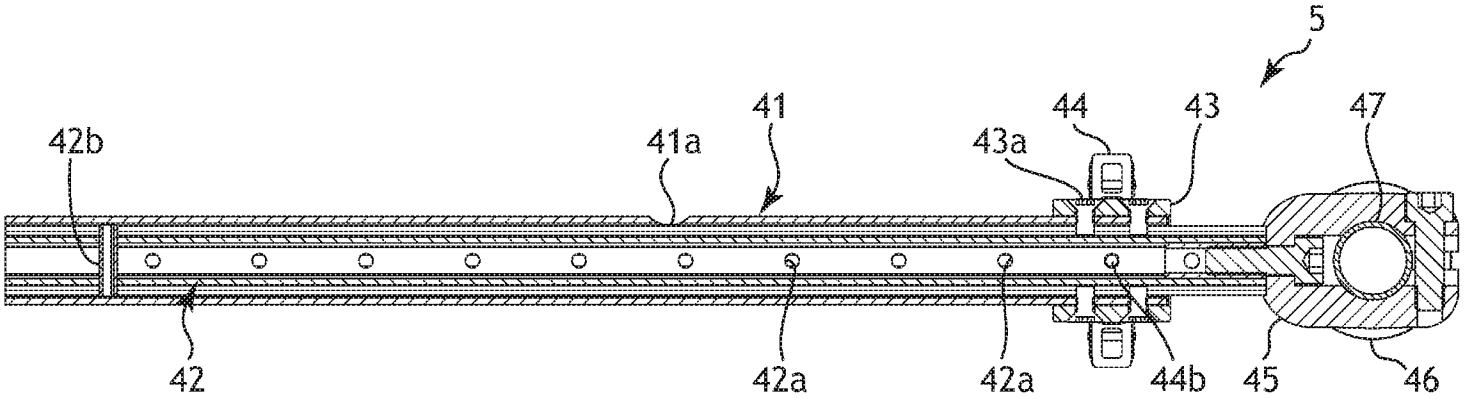
FIG. 34 is an explanatory drawing showing the retaining mechanism of the handle unit according to this example.
Figure 35:
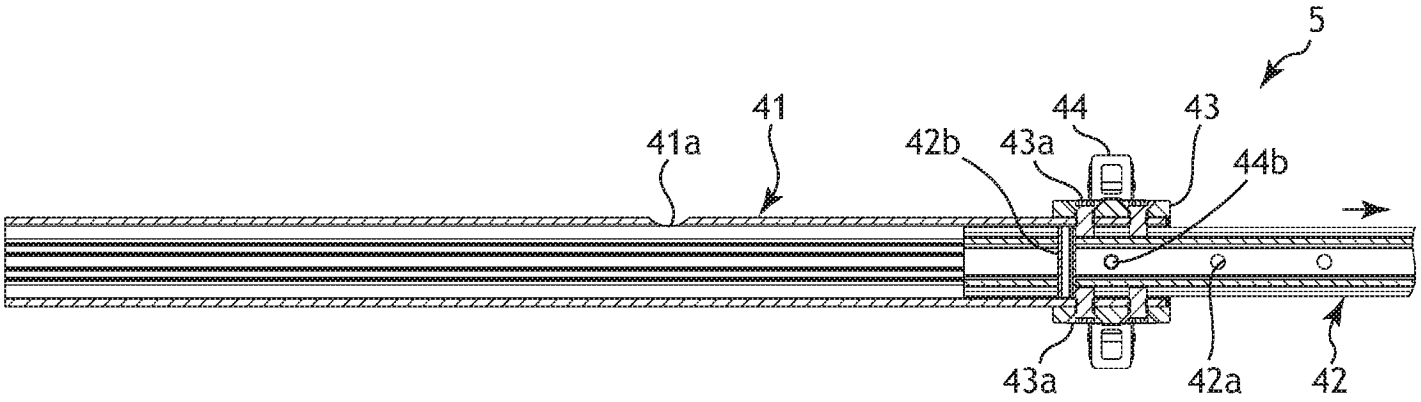
FIG. 35 is an explanatory drawing showing the retaining mechanism of the handle unit according to this example.

FIG. 33 to FIG. 35 are explanatory drawings each showing a retaining mechanism of the handle unit 5.

FIG. 33 shows a state seen from a tip of the outer shaft 41 in the handle shaft of the handle unit 5, and FIG. 34 and FIG. 35 are central sectional views of FIG. 33. Countersunk bolts 43*a* for fixing a later-described handle block 43 come into contact with a stopper pin 42*b* provided with both ends protruding at a tip of an inner shaft 42, thereby configuring a retainer.

As shown in FIG. 1, the handle unit 5 has a double structure consisting of the tubular outer shaft 41 and an inner shaft 42 which also has a tubular shape, and the inner shaft 42 is slidably incorporated in the outer shaft 41.

Furthermore, the handle block 43 is disposed at an outer periphery of an upper end portion of the outer shaft 41 by using the four countersunk bolts 43*a*, screw tip portions of a handle knob 44 screwed to a sidewall portion of this handle block 43 are arranged to abut on a sidewall portion of the inner shaft 42 placed in the outer shaft 41, the outer shaft 41 and the inner shaft 42 are integrally fixed by fastening the handle knob 44, and the inner shaft 42 can slid on the outer shaft 41 by loosening the handle knob 44.

Moreover, a handle bar 47 is disposed at an upper end portion of the inner shaft 42 through a handle bar block 45 to form the same dimension on left and right sides in the horizontal arrangement, and a pair of handle grips 46 are disposed to the handle bar 47.

With such a configuration of the handle unit 5, a protruding position of the inner shaft 42 to the outer shaft 41 can be adjusted by fastening or loosening the handle knob 44.

Figure 36:
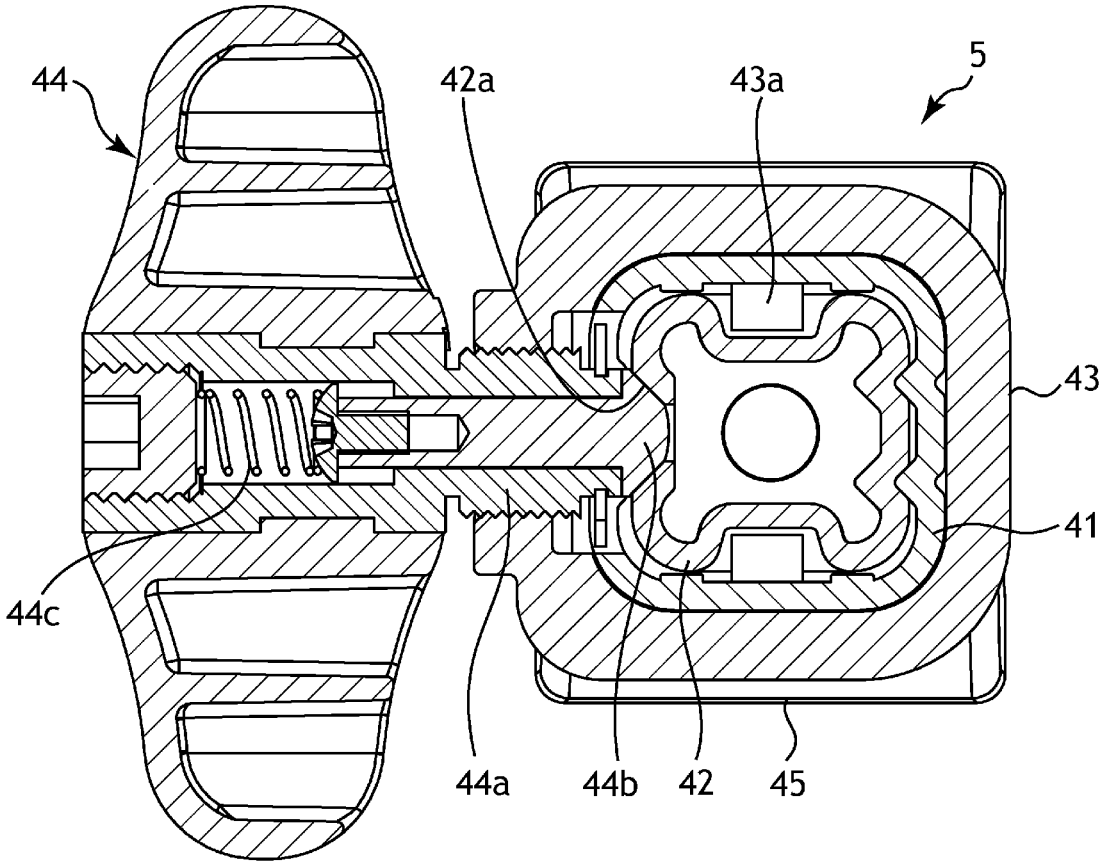
FIG. 36 is an explanatory drawing showing a length adjustment mechanism of the handle unit according to this example.
Figure 37:
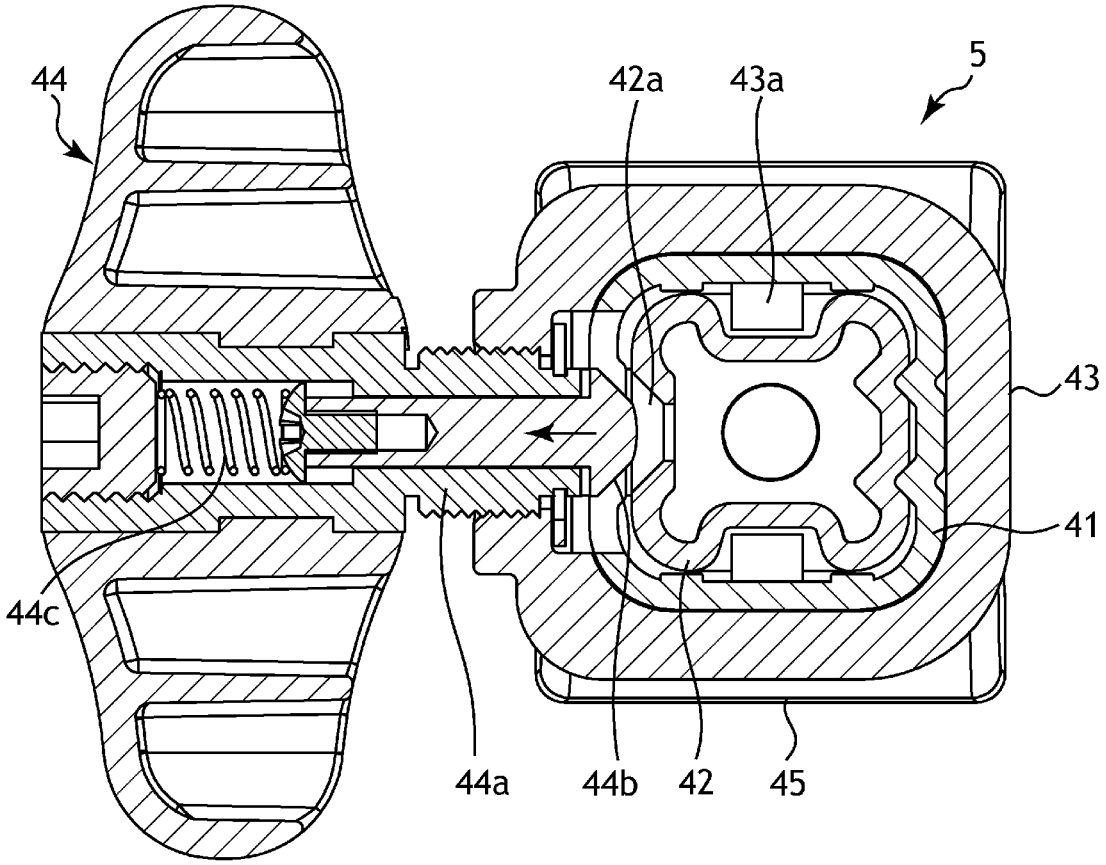
FIG. 37 is an explanatory drawing showing the length adjustment mechanism of the handle unit according to this example.

FIG. 36 and FIG. 37 are explanatory drawings each showing a length adjustment mechanism of the handle unit 5 according to this example.

FIG. 36 shows a state where the inner shaft 42 and the outer shaft 43 of the handle unit 5 are fixed, and also shows a state where a fixing head 44*b* is pressed against a countersink portion 42*a* of the inner shaft 42 by an insert shaft 44*a* when the handle knob 44 is turned and fastened in a clockwise direction.

FIG. 37 shows a state at the time of adjusting a length of the handle unit 5. The fixing head 44*b* is pressed against the countersink portion 42*a* of the inner shaft 42 by force of a spring 44*c* alone when the handle knob 44 is fully turned and fastened in a counterclockwise direction, the fixing head 44*b* escapes to the handle knob 44 side with a stroke so as to get on from the countersink portion 42*a* of the inner shaft 42 when the inner shaft 42 is slid, and hence the inner shaft 42 can adjust a length of the handle unit while the fixing head 44*b* and the countersink portion 42*a* abut on each other and slide clicking.

That is, according to this example, an adjustment configuration for a protruding position of the inner shaft 42 to the outer shaft 41 enables height adjustment of the handle grip 46 to the grip unit 2, i.e., height adjustment of the handle grip 46 in the successive screw fastener 1, thereby flexibly coping with differences in height between operators.

A coupling configuration of the grip unit 2 and the screw fastener main body unit 3 will now be described with reference to FIG. 6 to FIG. 8.

Figure 6:
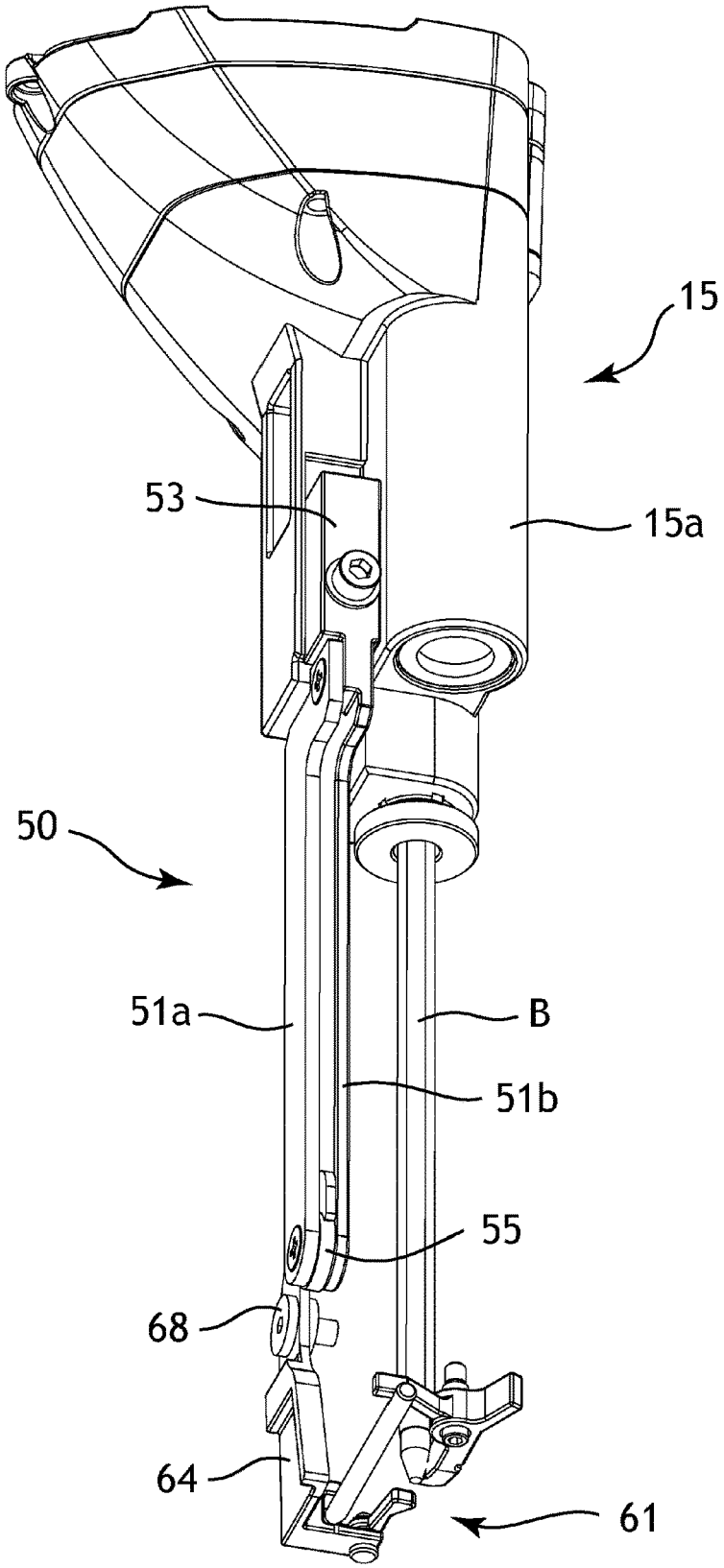
FIG. 6 is a schematic perspective view showing a feed lever operation body disposed to a block head in this example.

As shown in FIG. 6, a feed lever operation body 50 which has an upper end portion coupled with the block head 15 and a lower end side facing the inside of the screw fastener main body unit 3 and which will be described later in detail is arranged between the grip unit 2 and the screw faster main body unit 3.

As shown in FIG. 6, the feed lever operation body 50 includes a pair of rectangular tabular stopper plates 51*a* and 51*b*, upper end portions of these plates are collectively mounted on the back side of the block head 15 through a plate mounting block 53, and lower end sides of these plates are vertically suspended downward and engaged with a feed lever 64, which will be described later in detail, in the screw fastener main body unit 3.

Figure 7:
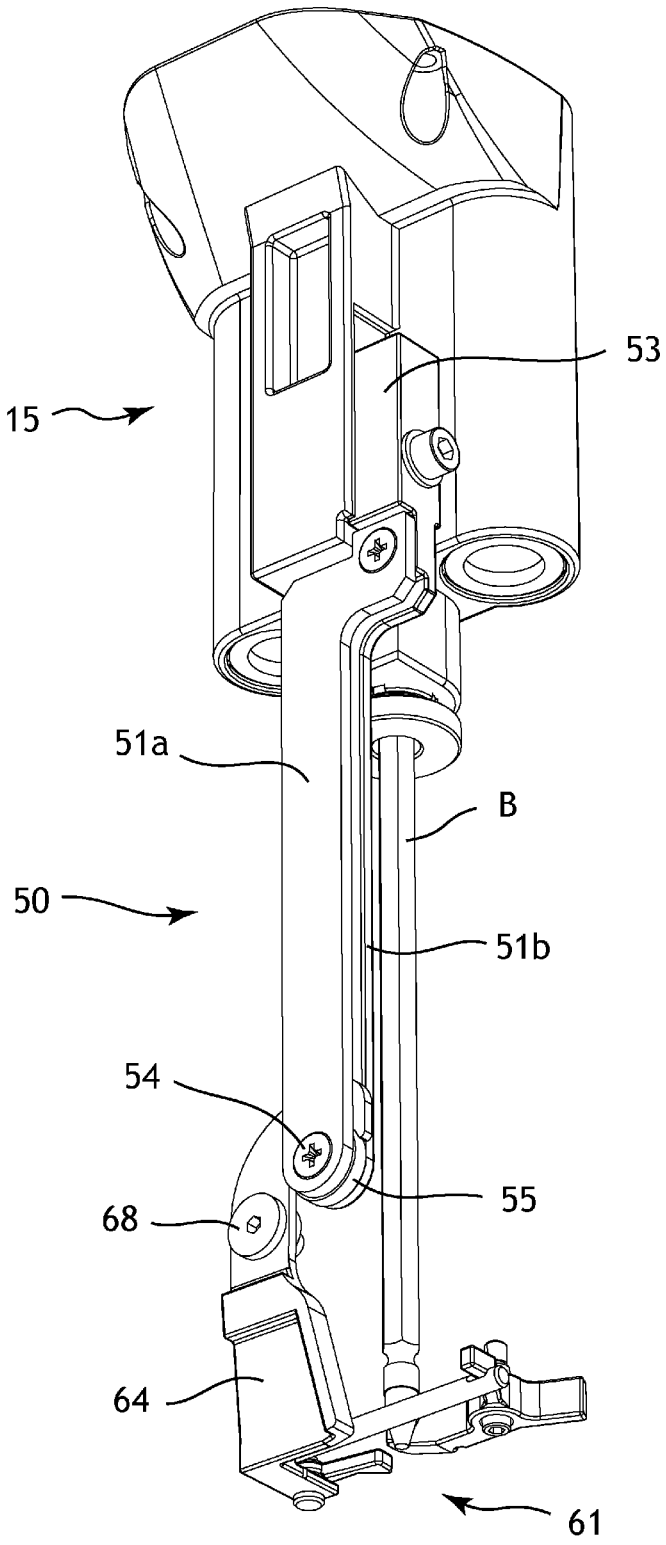
FIG. 7 is a schematic perspective view showing an engagement state between the feed lever operation body shown in FIG. 6 and a stop recessed portion of the feed lever of a screw feed mechanism section.

That is, the stopper plates 51*b* and 51*a* are sequentially arranged from the front side to the back side of the block head 15, and a stopper roller 55 rotatably supported by a shaft pin 54 horizontally disposed between the lower end portions of the stopper plates 51*a* and 51*b* can be engaged with a stop recessed portion 64*a* of the feed lever 64 as shown in FIG. 7.

Figure 8:
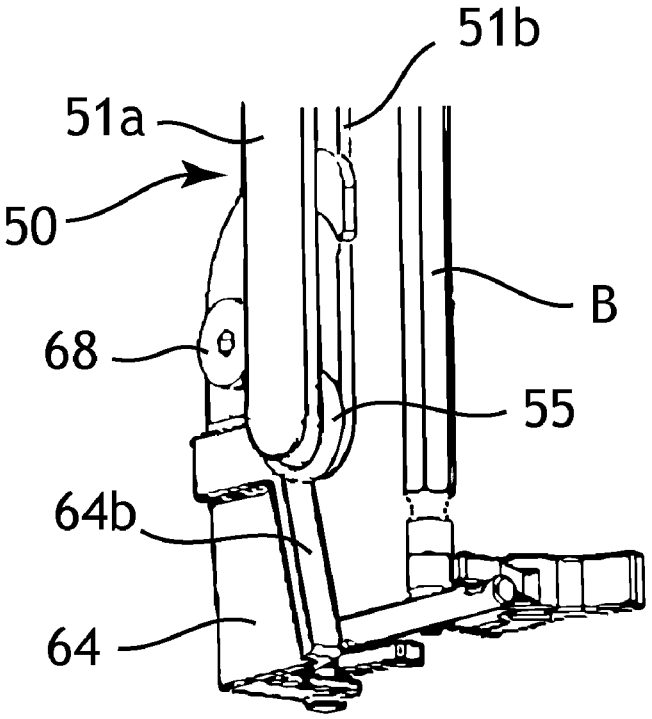
FIG. 8 is a schematic perspective view showing an engagement state between the fed lever operation body shown in FIG. 6 and an inclined face portion of the screw feed mechanism section.

Moreover, as shown in FIG. 8, a feed lever turning roller 55 rotatably supported by a feed lever pin 68 horizontally disposed between the lower end portions of the pair of rectangular tubular stopper plates 51*a* and 51*b* can be engaged with an inclined face portion 64*b* of the feed lever 64.

The screw faster main body unit 3 will now be described with reference to FIG. 1 and FIG. 10 to FIG. 14.

The screw fastener main body unit 3 has a feeder block 62 having a box-like shape which defines its appearance as a main constituent part, and the tip portion of the bit B protruded from the grip unit 2 faces a fastening acting position in the feeder block 62.

Figure 10:
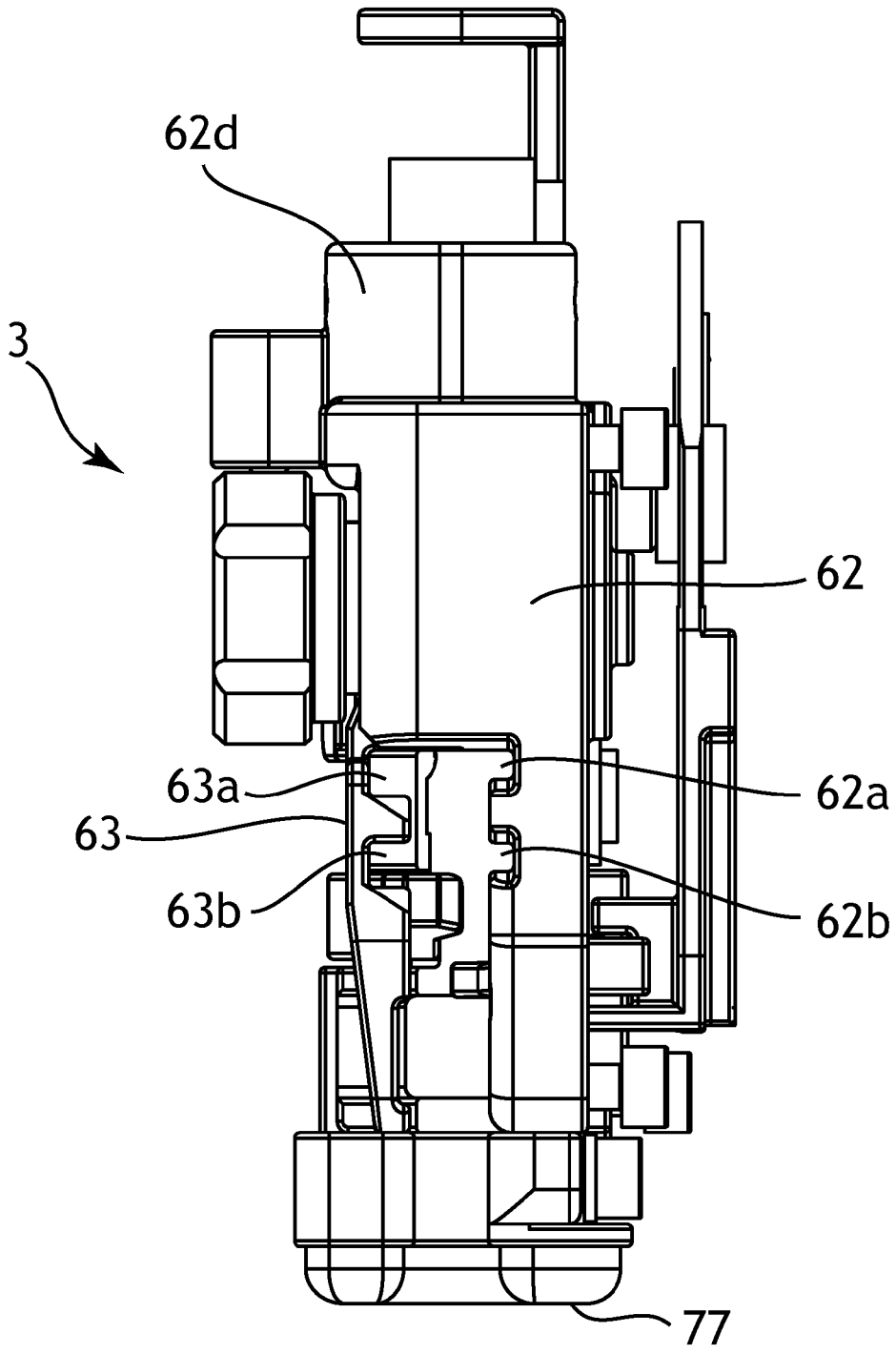
FIG. 10 is a schematic right side elevation of the screw feed mechanism section provided to a screw fastener main body unit according to this example.
Figure 11:
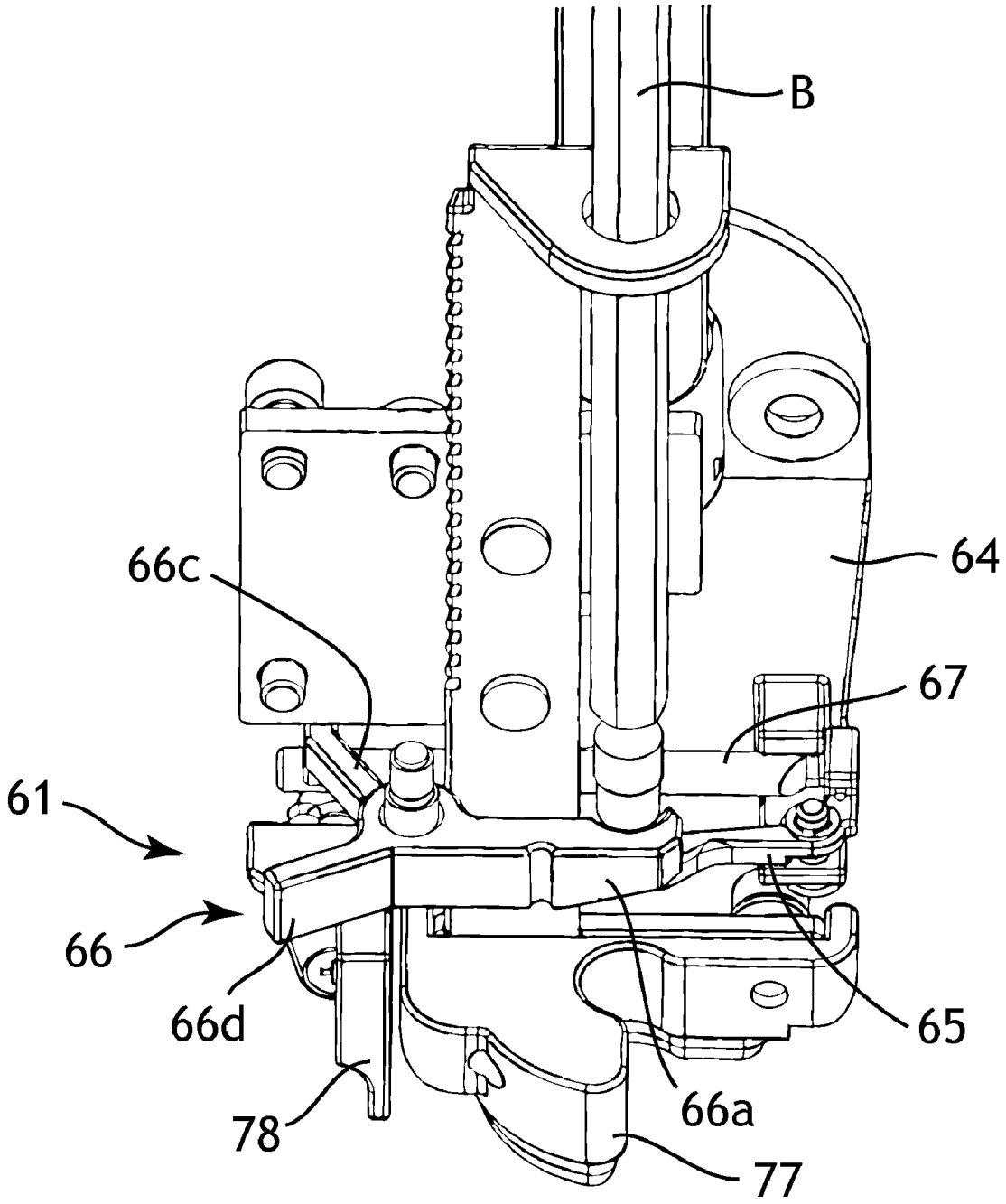
FIG. 11 is a schematic perspective view showing a configuration from which a feeder block of the screw feed mechanism section is removed and a bit according to this example.
Figure 12:
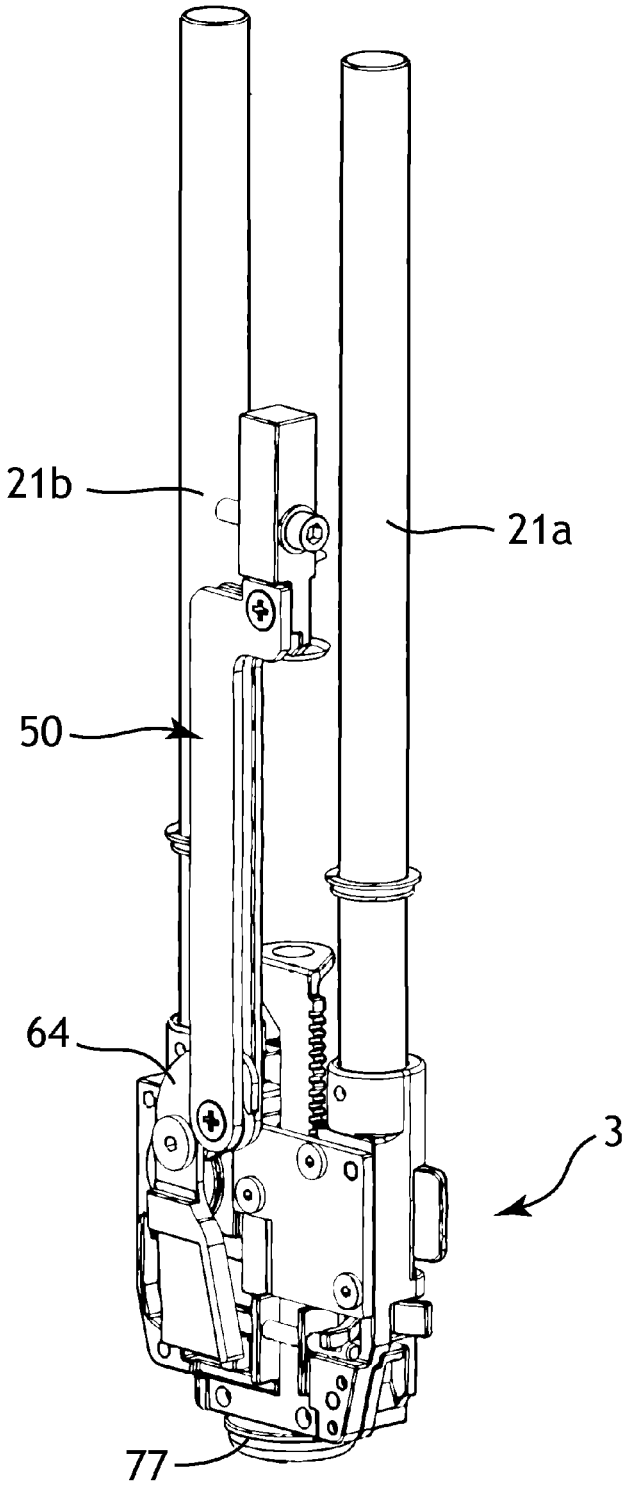
FIG. 12 is a schematic perspective view showing a state where the screw feed mechanism section is seen from a rear side according to this example.
Figure 20:
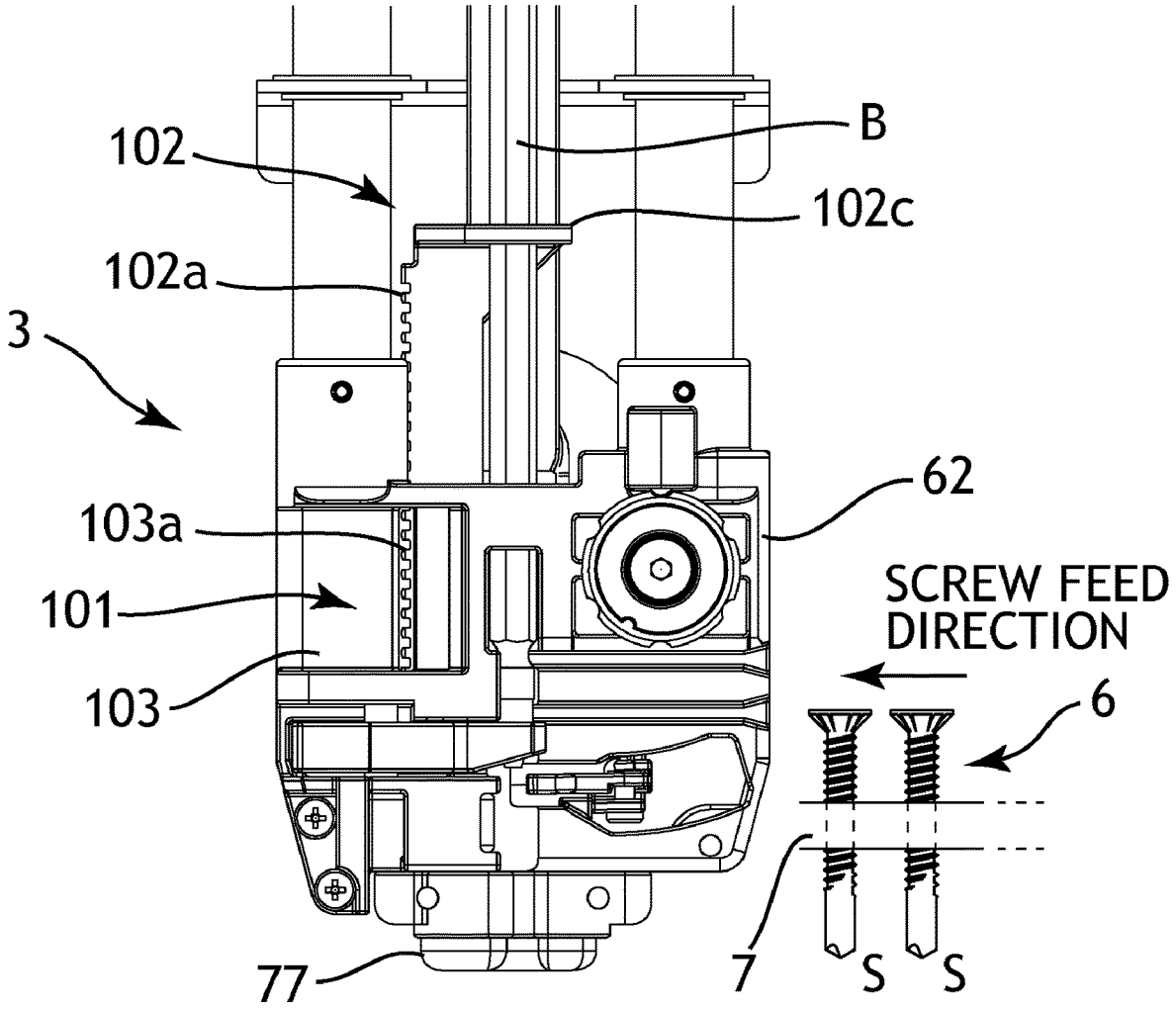
FIG. 20 is a schematic front view showing the screw guide position adjustment mechanism section provided to the screw fastener main body unit according to this example.

Additionally, the screw fastener main body unit 3 incorporates a screw feed mechanism section 61 which feeds to the fastening acting position each screw S disposed to a strip-like member 7 of a screw rope 6 supplied from a side portion of the screw faster main body unit 3 shown in FIG. 10 or FIG. 20 in tandem with a fastening operation of the screw fastener main body unit 3.

In an upper surface portion of the feeder block 62 are provided a pair of guide pole receiving portions 62*c* and 62*d* which are inserted into the pair of guide pole insertion tubes 15*a* and 15*b* of the block head 15 in the grip unit 2 and to which lower end portions of a pair of guide poles 21*a* and 21*b* which guide falling and rising operations of the block head 15, i.e., the grip unit 2 are attached.

The screw feed mechanism section 61 will now be described.

As shown in FIG. 10 to FIG. 14, the screw feed mechanism section 61 has the feeder block 62, a guide cover 63 which is disposed on a right side of a front surface of this feeder block 62 so that its position to the feeder block 62 in the front-and-back direction (a depth direction of the feeder block 62) can be finely adjusted, and a release lever 67.

As shown in FIG. 10 to FIG. 14, the screw feed mechanism section 61 has the feeder block 62, the guide cover 63 which is disposed on a right side of a front surface of this feeder block 62 so that its position to the feeder block 62 in the front-and-back direction (a depth direction of the feeder block 62) can be finely adjusted, the feed lever 64, a feed latch 65, a grip finger 66, and the release lever 67, and an operation of the grip finger 6 is interlocked with the feed latch 65 by the release lever 67.

That is, the feed latch 65 is interlocked by a simple single link structure using the release lever 67, the operation of the grip finger 66 is interlocked with the feed latch 65 by the release lever 67, and the feed latch 65 is operated by the grip finger 66.

As shown in FIG. 10, upper and lower screw head concave grooves 62*a* and 62*b* through which the head portion of each screw S passes are provided in a front surface of the feeder block 62 on the right side. Further, upper and lower screw head concave grooves 63*a* and 63*b* are provided in a rear surface of the guide cover 63 in the arrangement corresponding to the upper and lower screw head concave grooves 62*a* and 62*b*.

The feed lever 64 is turnably supported in the vertical arrangement by a feed lever pin 68 in the screw fastener main body unit 3.

Figure 14:
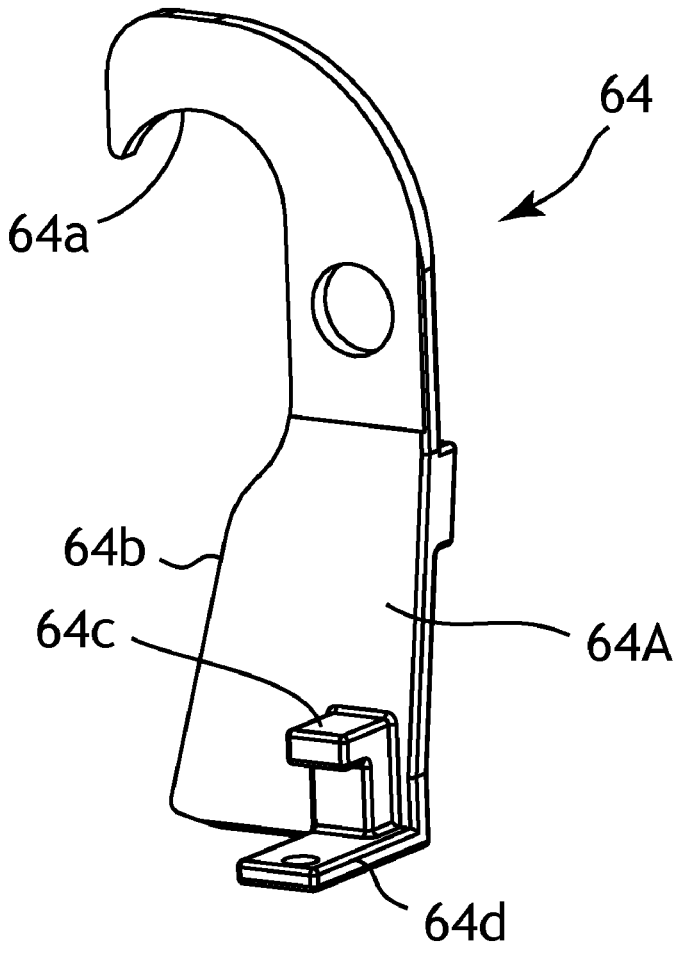
FIG. 14 is a schematic perspective view of the feed lever alone of the screw feed mechanism section according to this example.

Furthermore, as solely shown in FIG. 14, in the feed lever 64, the curved stop recessed portion 64*a* which is engaged with the feed lever operation body 50 is provided on an upper side of a lever main body 64A, the inclined face portion 64*b* which is likewise engaged with the feed lever operation body 50 is provided below this stop recessed portion 64*a*, and a protruding piece 64*c* which abuts on the feed latch 65 and a support plate portion 64*d* which supports the feed latch 65 are provided on a lower right side of the lever main body 64A in a vertical two-stage arrangement.

The feed latch 65 integrally form a latch piece 65*a* for the screws S and a turning receiving piece 65*b* in a substantially-90-degree arrangement, and a substantially intermediate portion between both these members is supported to be turnable on the support plate portion 64*d* by using a feed latch pin 69.

The feed latch pin 69 is arranged at a position substantially directly below the feed lever pin 68 which pivotally supports the feed lever 64.

Moreover, the latch piece 65*a* is arranged to face a region where each screw S passes, and the turning receiving piece 65*b* is arranged to face a region where the protruding piece 64*c* of the feed lever 64 is displaced.

A screw receiving concave portion 65*c* is provided in the latch piece 65*a*.

The grip finger 66 is turnably supported in the horizontal arrangement at a position on the left side of the feed latch 65 by a grip finger pin 70 in the screw fastener main body unit 3.

The grip finger 66 is formed into a structure where three pieces, i.e., a grip piece 66*a* for the screw S having a screw holding concave portion 66*b* on a tip side arranged to face the fastening acting position of the screw S and its vicinity, a link piece 66*c*, and a finger operation piece 66*d* protrude in three directions from a position of the grip finger pin 70.

The link piece 66*c* has its tip side arranged to face a left position of the abutting receiving piece 65*b*, and the finger operation piece 66*d* has its tip side exposed to a left front surface of the feeder block 62.

In the release lever 67, a tip side of the link piece 66*c* is engaged with a concave portion 67*a* provided near a left end of the release lever 67, and a right end portion of the release lever 67 is arranged to face the abutting receiving piece 65*b* of the feed latch 65 and the vicinity thereof.

According to the screw feed mechanism section 61, since a fulcrum point of the feed latch pin 69 which supports the feed latch 65 is arranged as described above, just inserting the screw rope 6 holding the screws S between the feeder block 62 and the guide cover 63 enables easily and rapidly feeding one screw S arranged in the screw rope 6 by using the latch piece 65*a* of the feed latch 65.

That is, the screw rope 6 holding the screws S is inserted between the feeder block 62 and the guide cover 63.

Figure 13:
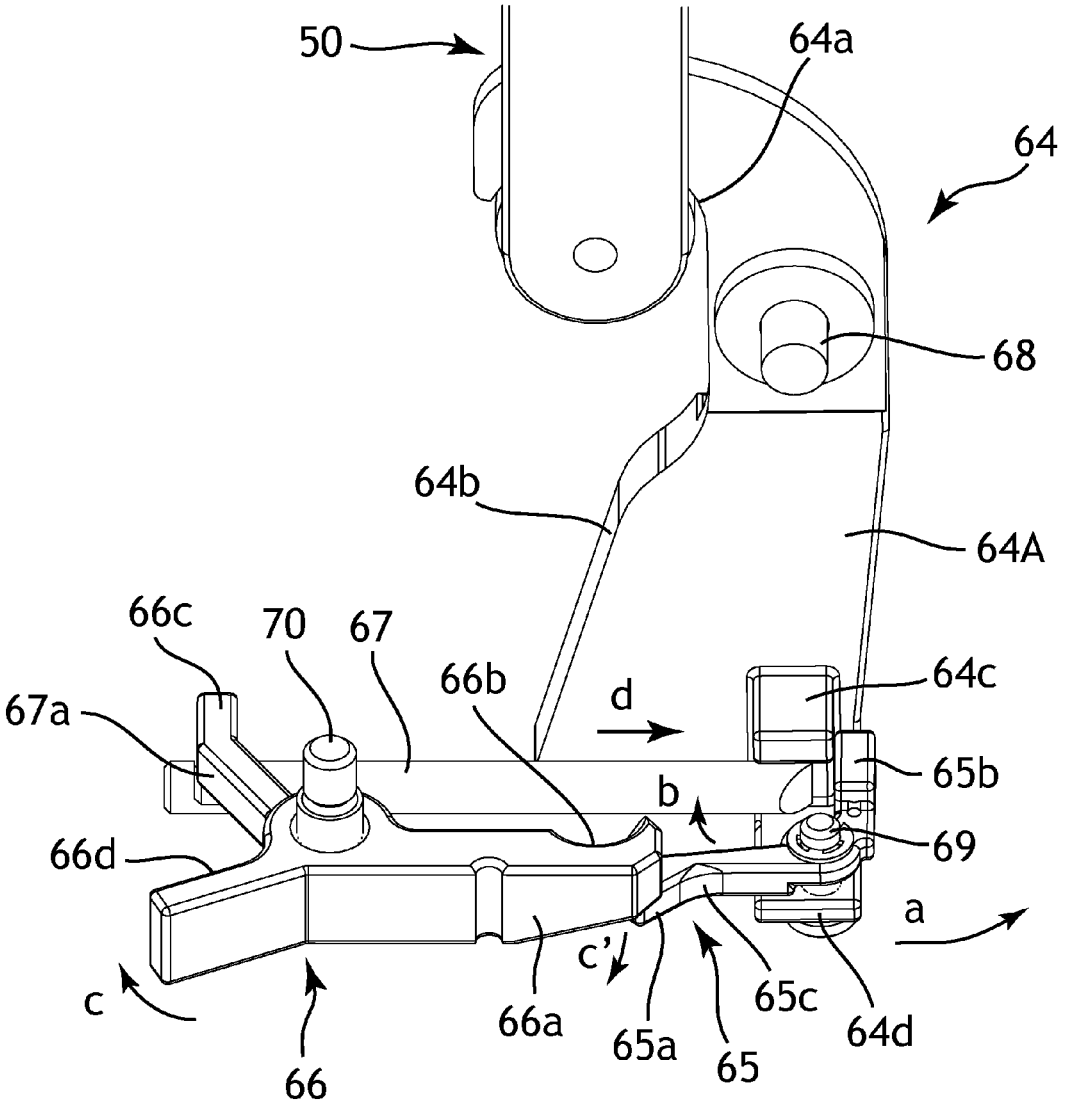
FIG. 13 is a schematic perspective view showing each constituent element of the screw feed mechanism section according to this example.

Furthermore, slightly moving down the grip unit 2 allows the stopper roller 55 supported by the stopper plates 51*a* and 51*b* of the feed lever operation body 50 to push down the inclined face portion 64*b* of the feed lever 64, and this feed lever 64 is turned in the vertical direction and the counterclockwise direction in FIG. 13 while using the feed lever pin 68 as a support shaft.

With this operation, the protruding piece 64*c* and the support plate portion 64*d* are displaced in a direction of an arrow a while turning in the horizontal direction and the counterclockwise direction at a slight slant while using the feed lever pin 68 as a support shaft.

At the same time, the feed latch 65 turns in a direction of an arrow b against the screw S abutting on the screw receiving concave portion 65*c* while using the feed latch pin 69 as a support shaft, and the feed latch 65 returns to its original position after the tip of the latch piece 65 passes through the screw S.

Consequently, the head of the screw S pushes up the grip finger 66 in a direction of an arrow c', and the screw feeding to the fastening acting position of the screw S arranged in the screw rope 6 can be simply and easily carried out while avoiding interference of the head portion of the screw S and the bit B.

On the other hand, in case of removing the screw rope 6, when the finger operation piece 66*d* of the grip finger 66 is operated in a direction of an arrow c shown in FIG. 13, the release lever 67 moves in a direction of an arrow d through the link piece 66*c*, the turning receiving piece 65*b* of the feed latch 65 is turned, and the latch piece 65*a* turns in a direction (the direction of the arrow b) to move away from the screw S arranged in the screw rope 6.

Consequently, the screw rope 6 holding the screws S can be easily removed from the screw feed mechanism section 61.

According to the above-described screw feed mechanism section 61, the head of the screw S pushes up the grip finger 66 while avoiding the interference between the head portion of the screw S and the bit B, the screw feeding to the fastening acting position of the screw S arranged in the screw rope 6 can be simply and easily performed, and the screw rope 6 holding the screws S can be simply and easily removed based on a structure with improved durability which is a simple link structure using the release lever 67.

A gap adjustment mechanism section 91 provided in the screw fastener main body unit 3 will now be described with reference to FIG. 15 to FIG. 18.

The gap adjustment mechanism section 91 has the guide cover 63 disposed on the right side of the front surface of the feeder block 62 to be translatable in the front-and-back direction, can adjust a gap (an interval) between the feeder block 62 and the guide cover 63 to be widened or narrowed, and can guide the screw S toward the fastening acting position while supporting it in the vertical arrangement.

Figure 15:
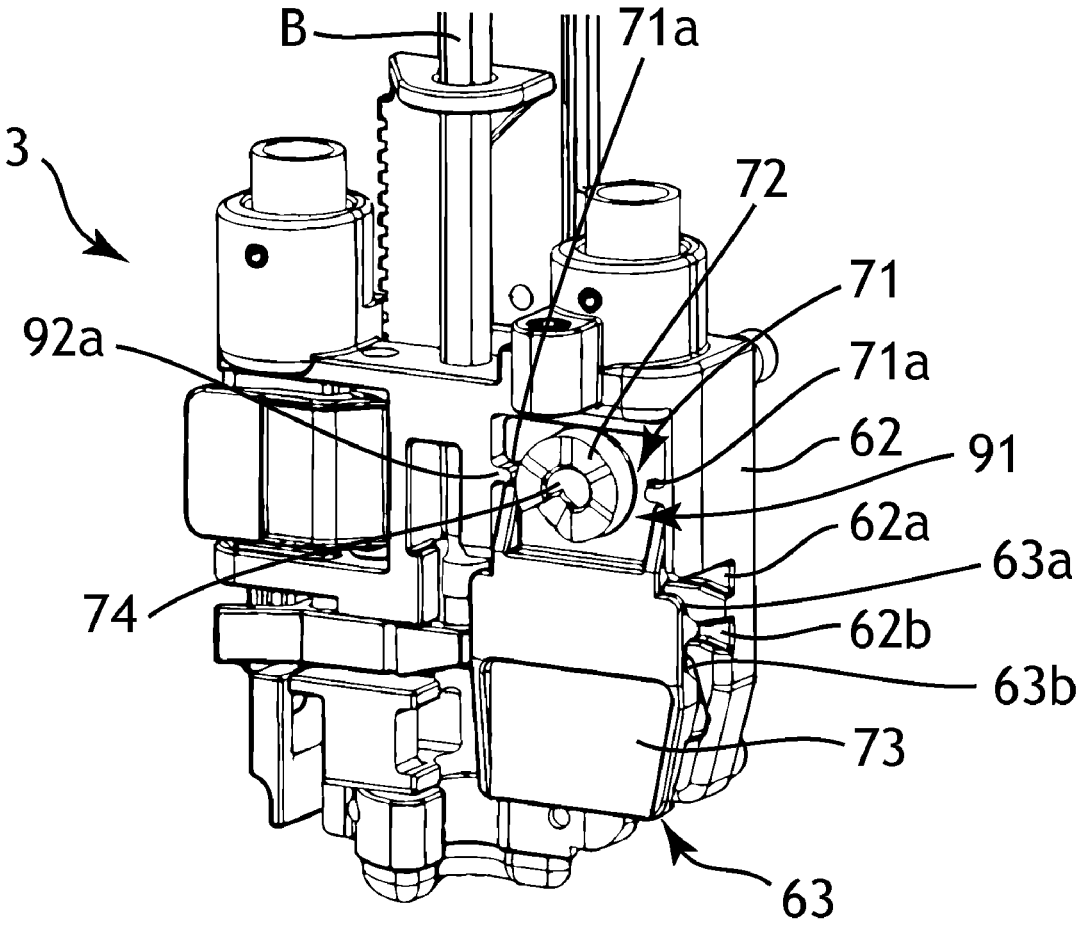
FIG. 15 is a schematic perspective view showing a gap adjustment mechanism section provided in the screw fastener main body unit in a state where a guide cover and an adjustment dial are removed according to this example.

That is, as shown in FIG. 15, a recessed portion 92 in which the guide cover 63 is disposed is provided on the right side of the front surface of the feeder block 62. Sliding protruding pieces 92*a* are provided at two positions on left and right inner wall portions of the recessed portion 92 in the front-and-back direction.

Figure 16:
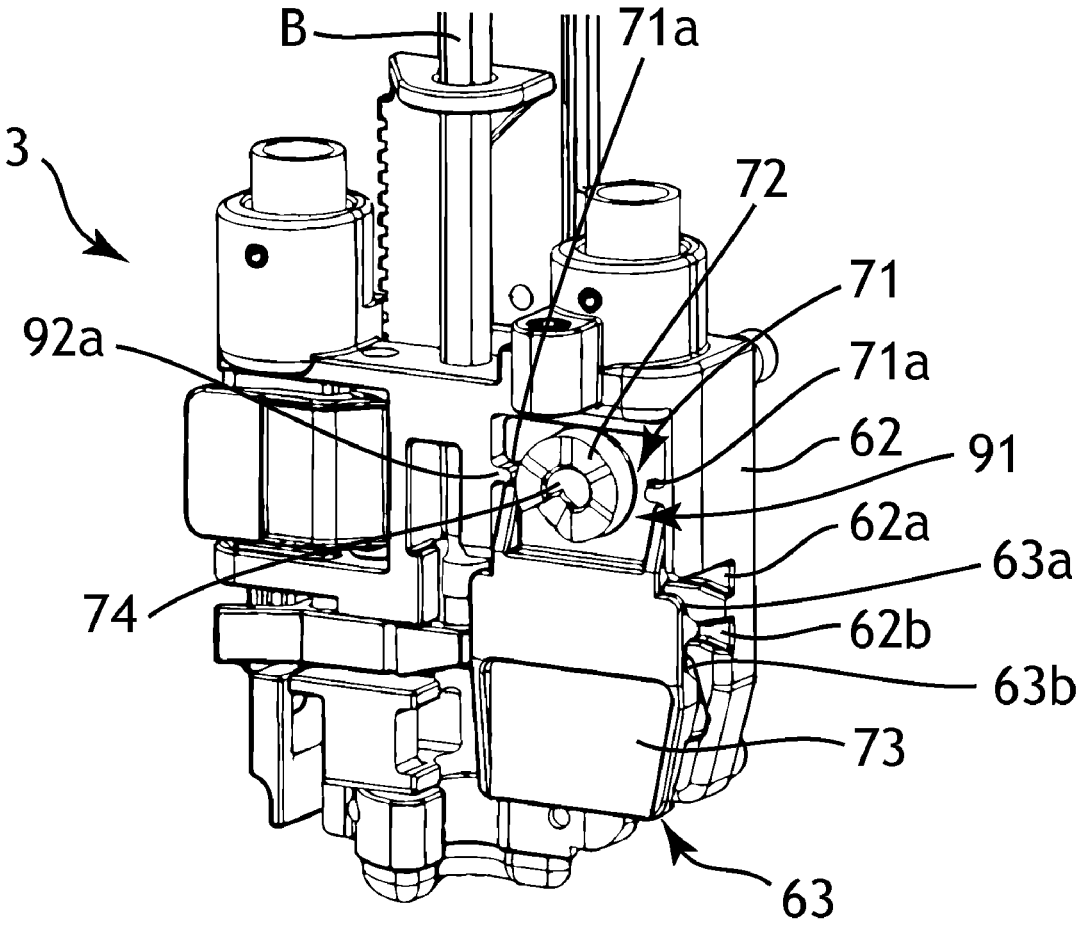
FIG. 16 is a schematic perspective view showing a state where the adjustment dial is removed in the gap adjustment mechanism section provided to the screw fastener main body unit according to this example.

On the other hand, as shown in FIG. 16, the guide cover 63 is provided by integrally forming an adjustment block portion 71 formed into a box-like shape having a circular stage cam 72 provided on a front surface thereof and a screw guide plate portion 73 having the screw head portion concave grooves 63*a* and 63*b* provided to face the screw head portion concave grooves 62*a* and 62*b* of the feeder block 62.

As shown in FIG. 16, the adjustment block portion 71 is attached in the recessed portion 92, can slide in the front-and-back direction, and has concave grooves 71*a* in which the sliding protruding pieces 92*a* are fitted respectively at two positions on both sidewall portions thereof. Consequently, the adjustment block portion 71 can accurately slide in the front-and-back direction without being displaced to the recessed portions 92.

As shown in FIG. 16, the circular stage cam 72 has cam surfaces having, e.g., six different heights circularly arranged and also has a through hole 74 formed at a central portion thereof.

Figure 17:
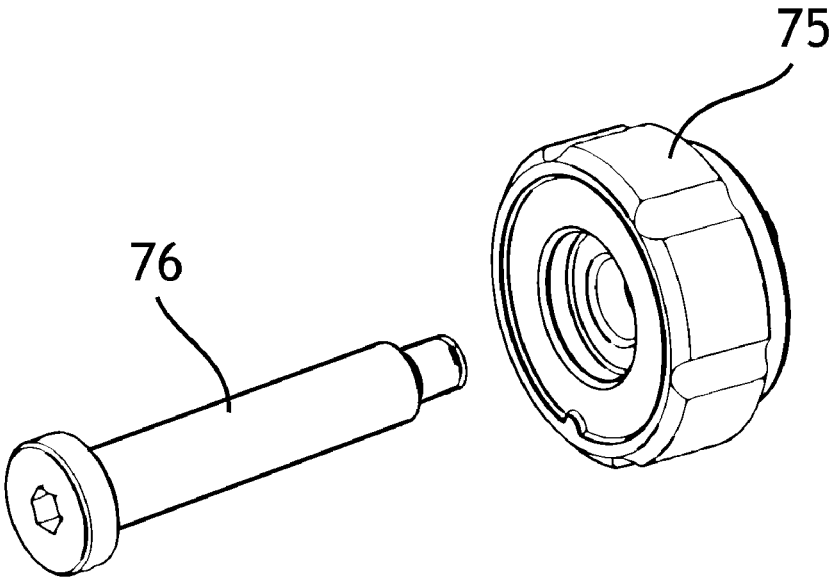
FIG. 17 is a schematic perspective view of the adjustment dial alone constituting the gap adjustment mechanism section provided to the screw fastener main body unit according to this example.

Further, as shown in FIG. 1 and FIG. 17, the gap adjustment mechanism section 91 includes an adjustment dial 75 and a support screw 76 to dispose the guide cover 63 to the right side of the front surface of the feeder block 62.

Furthermore, the support screw 76 is screwed into a central portion of the adjustment dial 75, protruded toward the rear side, and pierced through the through hole 74 of the circular stage cam 72, and the guide cover 63 is disposed to the right side of the front surface of the feeder block 62 by fastening and fixing a tip portion of this support screw 76 in a central hole 92*b* of the recessed portion 92. It is to be noted that a spring or a mechanical spring (not shown) configured to energize the guide cover 63 frontward is arranged in the gap adjustment mechanism section 91 between the guide cover 63 and the feeder block 62.

Figure 18:
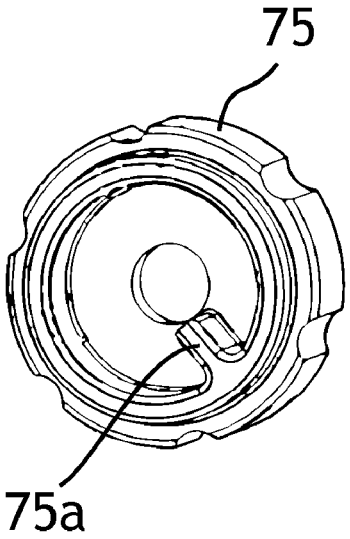
FIG. 18 is a schematic perspective view showing a state where the adjustment dial alone constituting the gap adjustment mechanism section provided to the screw fastener main body unit is seen from the rear side according to this example.
Figure 19:
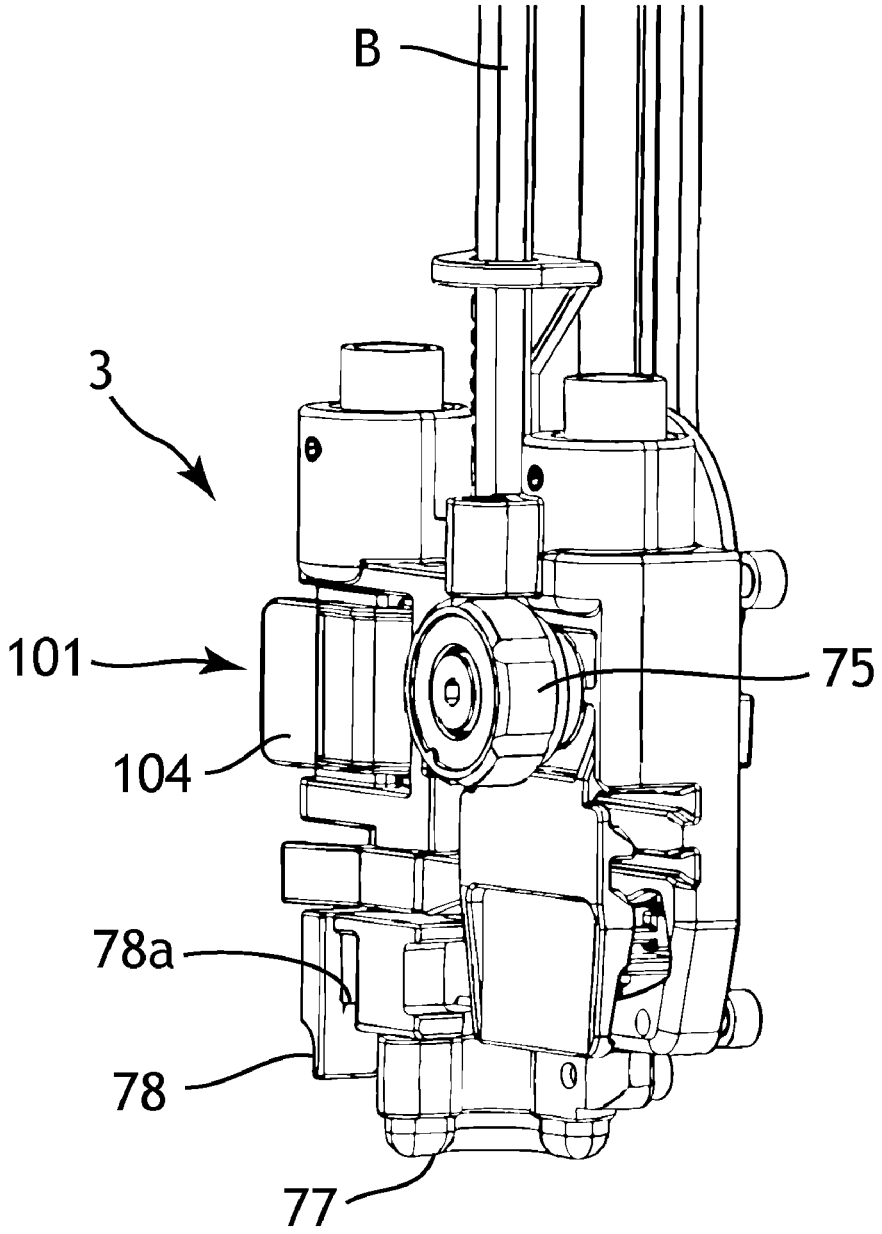
FIG. 19 is a schematic perspective view showing an adjusting lever of a screw guide position adjustment mechanism section provided to the screw fastener main body unit according to this example.

Moreover, in the adjustment dial 75, as shown in FIG. 18, a cam contact piece 75*a* arranged to abut on each cam surface of the circular stage cam 72 is provided.

According to the gap adjustment mechanism section 91 having such a configuration, when the adjustment dial 75 is operated to rotate, the cam contact piece 75*a* abuts on any one of the respective cam surfaces having different heights of the circular stage cam 72. Consequently, the adjustment block portion 71, i.e., the guide cover 63 precisely slide in the front-and-back direction in stages without being displaced to the recessed portion 92 in correspondence with a rotating position of the adjustment dial 75, and can adjust the gap (the interval) between the feeder block 62 and the guide cover 63 to be widened or narrowed, support each screw S passing between these members in the vertical arrangement, and accurately guide it toward the fastening acting position.

A screw guide position adjustment mechanism section 101 provided in the screw fastener main body unit 3 will now be described in detail with reference to FIG. 19 to FIG. 23.

The screw guide position adjustment mechanism section 101 is arranged at a lower end portion of the screw fastener main body unit 3, passes each screw S to be fastened, and adjusts a position of a screw guide 77, whose lower end surface abuts on a surface of a fastening target position of the screw S, to the screw fastener main body unit 3.

Figure 21:
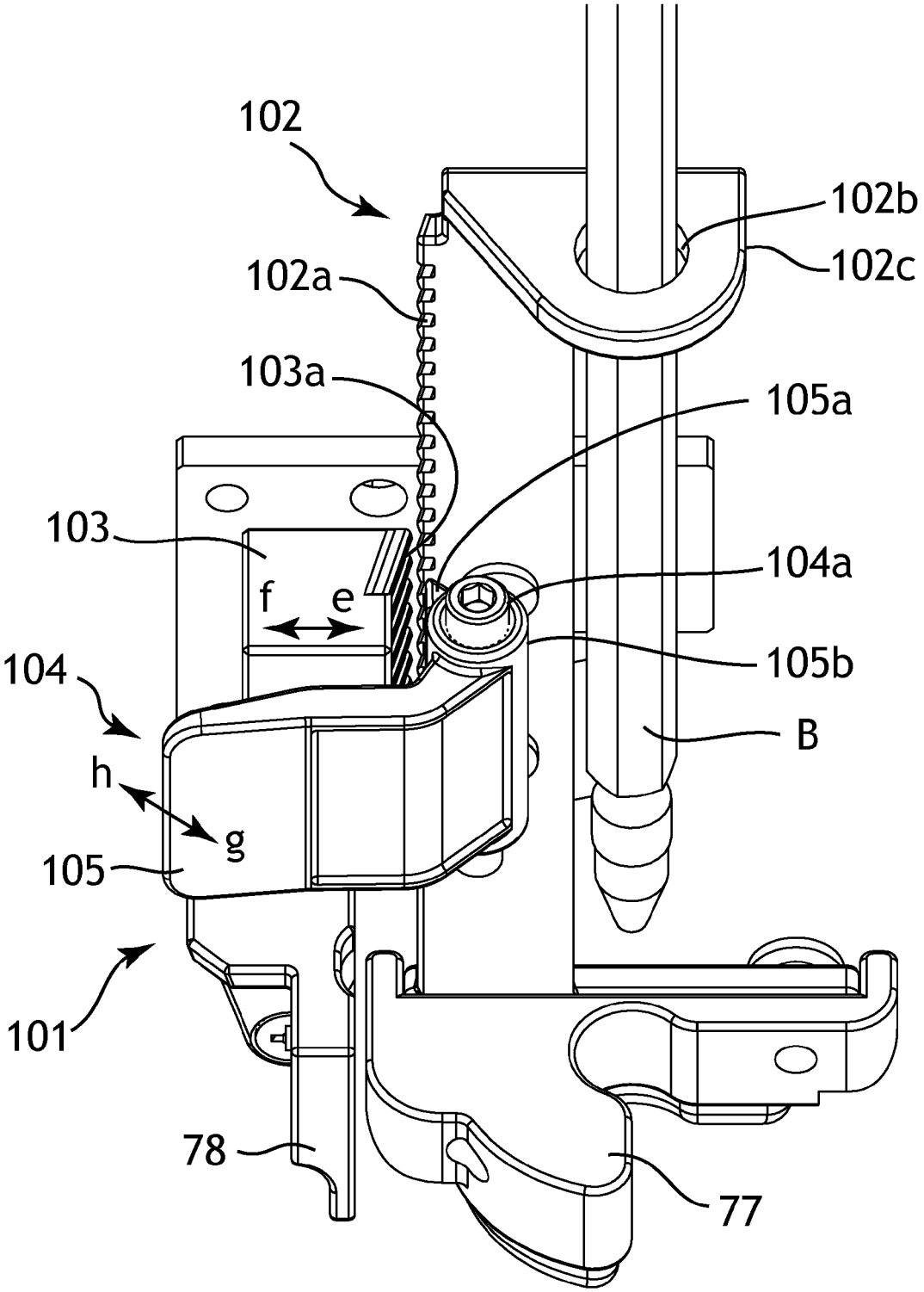
FIG. 21 is a schematic perspective view showing each element in the screw guide position adjustment mechanism section provided to the screw fastener main body unit, a bit, and a screw rope cutter according to this example.

The screw guide position adjustment mechanism section 101 is arranged as a left position of the adjustment dial 75 in the feeder block 62 so that it does not interfere with the bit B, and includes an adjusting plate 102 whose lower end portion is secured to a rear side of the screw guide 77 arranged below the feeder block 62 and whose upper end side is raised on a rear side of the bit B to be parallel to the bit B, an adjusting block 103 arranged in the feeder block 62 to be movable in the horizontal direction (directions of arrows e and f), and an adjusting lever 104 supported to be turnable in directions of arrows g and h shown in FIG. 21 by a support pin 104*a* arranged in the feeder block 62.

The adjusting plate 102 has a bent piece 102*c* having a bit hole 102*b* into which the bit can be inserted in a contactless manner at an upper end portion thereof, and also has a saw-tooth-like engaging irregular portion 102*a* vertically provided on a left side facing the adjusting block 103.

The adjusting block 103 has a saw-tooth-like engaging irregular portion 103*a* provided on a right end surface facing a vertical left side of the adjusting plate 102.

The adjusting block 103 is constantly energized toward the vertical left side of the adjusting plate 102 (in a direction of an arrow m) by a spring (not shown), and meshes the engaging irregular portion 103*a* with the engaging irregular portion 102*a* to restrict a position of the adjusting plate 102 in the vertical direction.

The adjusting lever 104 includes a fitting tube portion 105*b* fitted on a periphery of the support pin 104, and an operation piece 105 which is integral with this fitting tube portion 105*b* and exposed to the outside at a left position of the feeder block 62.

Additionally, an adjusting block operation protruding piece 105*a* arranged to face a position near a front corner portion of a right end surface of the adjusting block 103 is provided to the fitting tube portion 105*b*.

Figure 22:
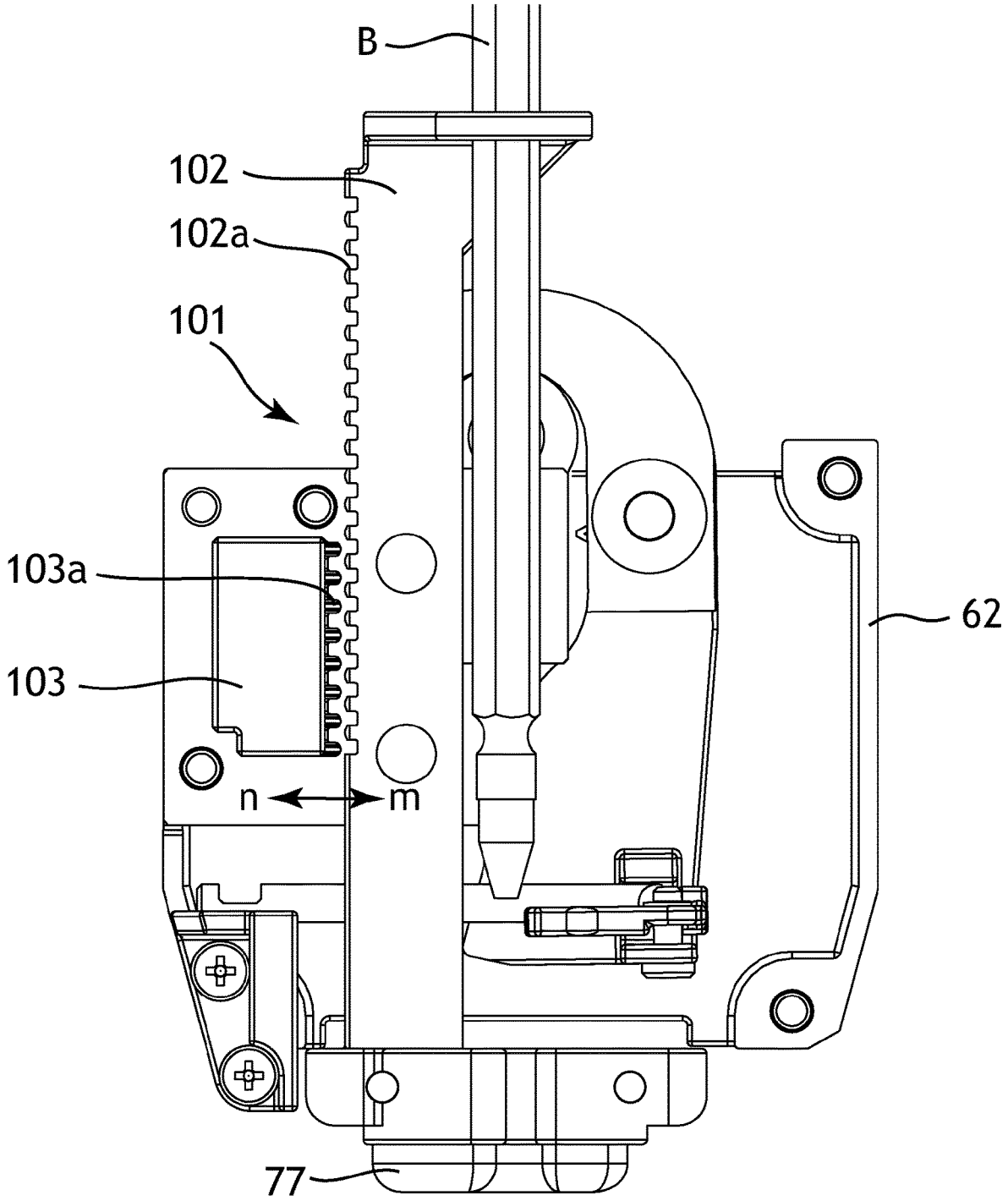
FIG. 22 is a schematic rear view showing a state where each element in the screw guide position adjustment mechanism section provided to the screw fastener main body unit is seen from the rear side according to this example.
Figure 23:
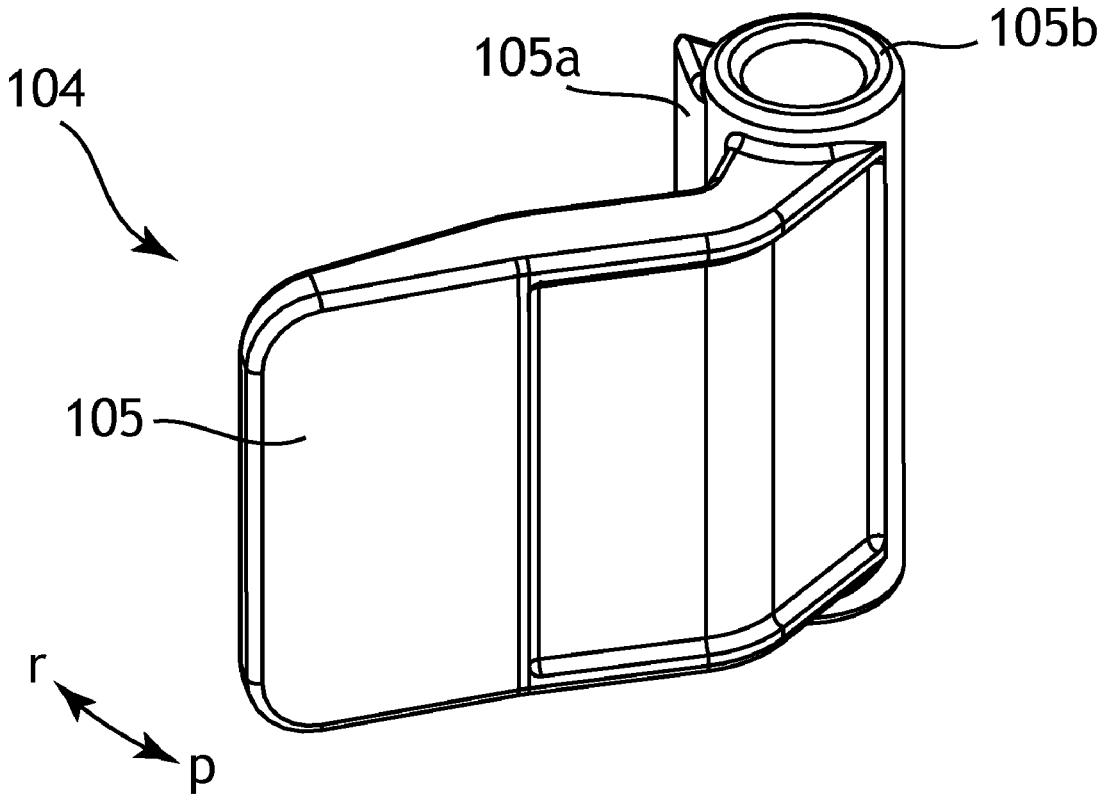
FIG. 23 is a schematic rear view showing the adjusting lever alone of the screw guide position adjustment mechanism section provided to the screw fastener main body unit according to this example.

According to the screw guide position adjusting mechanism 101, as shown in FIG. 22 and FIG. 23, when the adjusting lever 104 is operated in a direction of an arrow p, the adjusting block 103 moves in a direction of an arrow n, the engaging irregular portion 103*a* and the engaging irregular portion 102*a* are disengaged from each other, and a position of the adjusting plate 102 in the vertical direction can be adjusted, namely, a position of the screw guide 77 to the screw fastener main body unit 3 can be adjusted with a fine pitch corresponding to saw-tooth conformations of the engaging irregular portion 102*a* and the engaging irregular portion 103*a*.

Further, when the adjusting lever 104 is returned in a direction of an arrow r, the adjusting block 103 moves in a direction of an arrow m, the engaging irregular portion 103*a* is restored to mesh with the engaging irregular portion 102*a*, and hence the position of the adjusting plate 102 in the vertical direction is restricted, namely, a position of the screw guide 77 to the screw fastening main body unit 3 can be fixed to a predetermined position.

The screw fastener main body unit 3 further has a screw rope cutter 78 arranged on a left side of the screw guide 77 below the feeder block 62. When an empoty state is produced in the screw rope 6 discharged to the left side of the screw guide 77 and the empoty state is prolonged at the time of an operation of fastening the screws S using the successive screw fastener 1 according to this example, an operator steps on this empoty screw rope 6, and the screw fastener main body unit 3 is lifted up, whereby the screw rope 6 can be simply cut by a cutter blade portion 78*a* provided to the screw rope cutter 78, which results in an improvement in convenience.

A magazine mounting mechanism section 111 provided to the screw fastener main body unit 3 and the magazine unit 4 will now be described with reference to FIG. 24 to FIG. 29.

Figure 24:
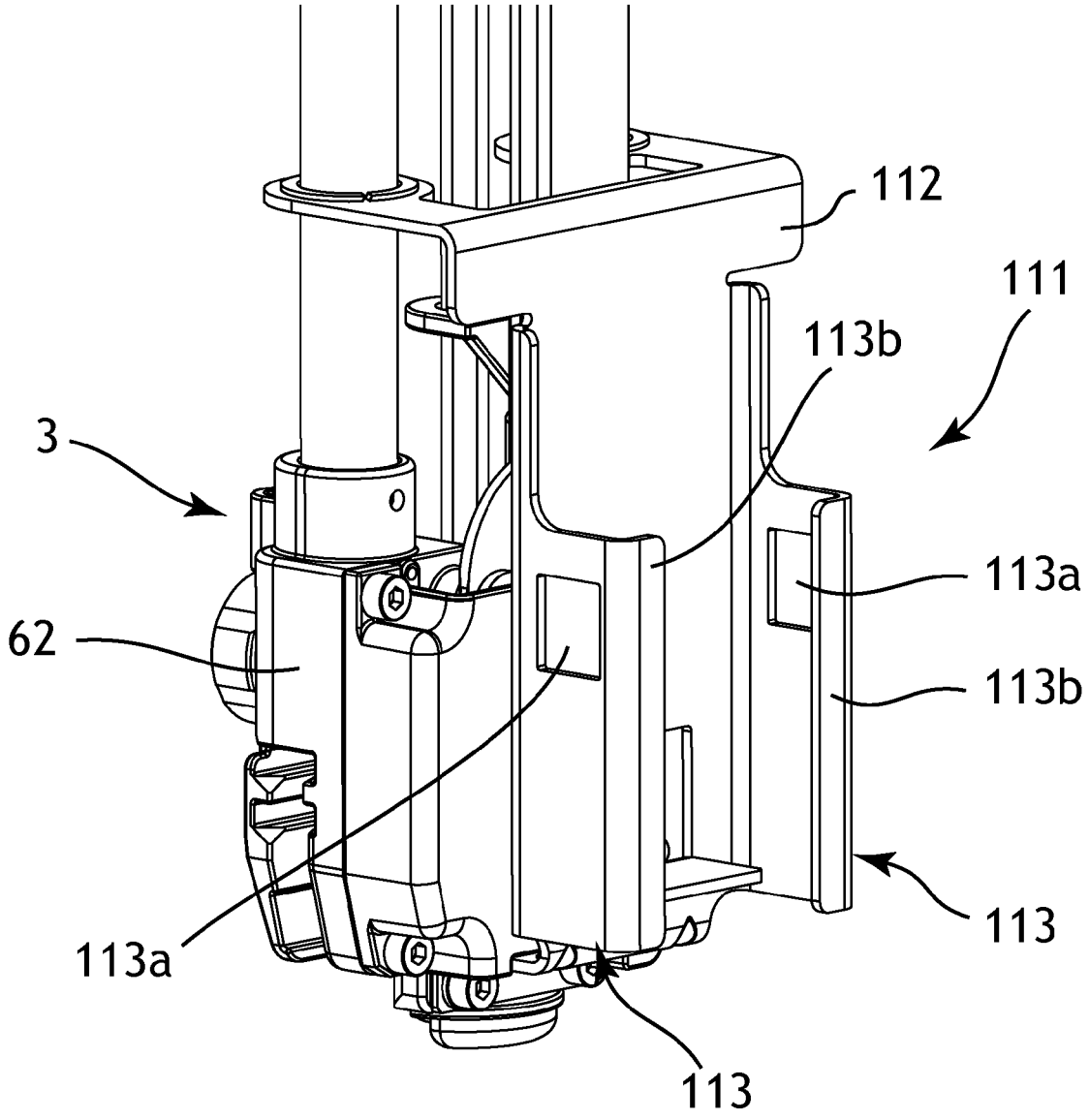
FIG. 24 is a schematic perspective view showing a magazine mounting mechanism section provided to the screw fastener main body unit according to this example.
Figure 25:
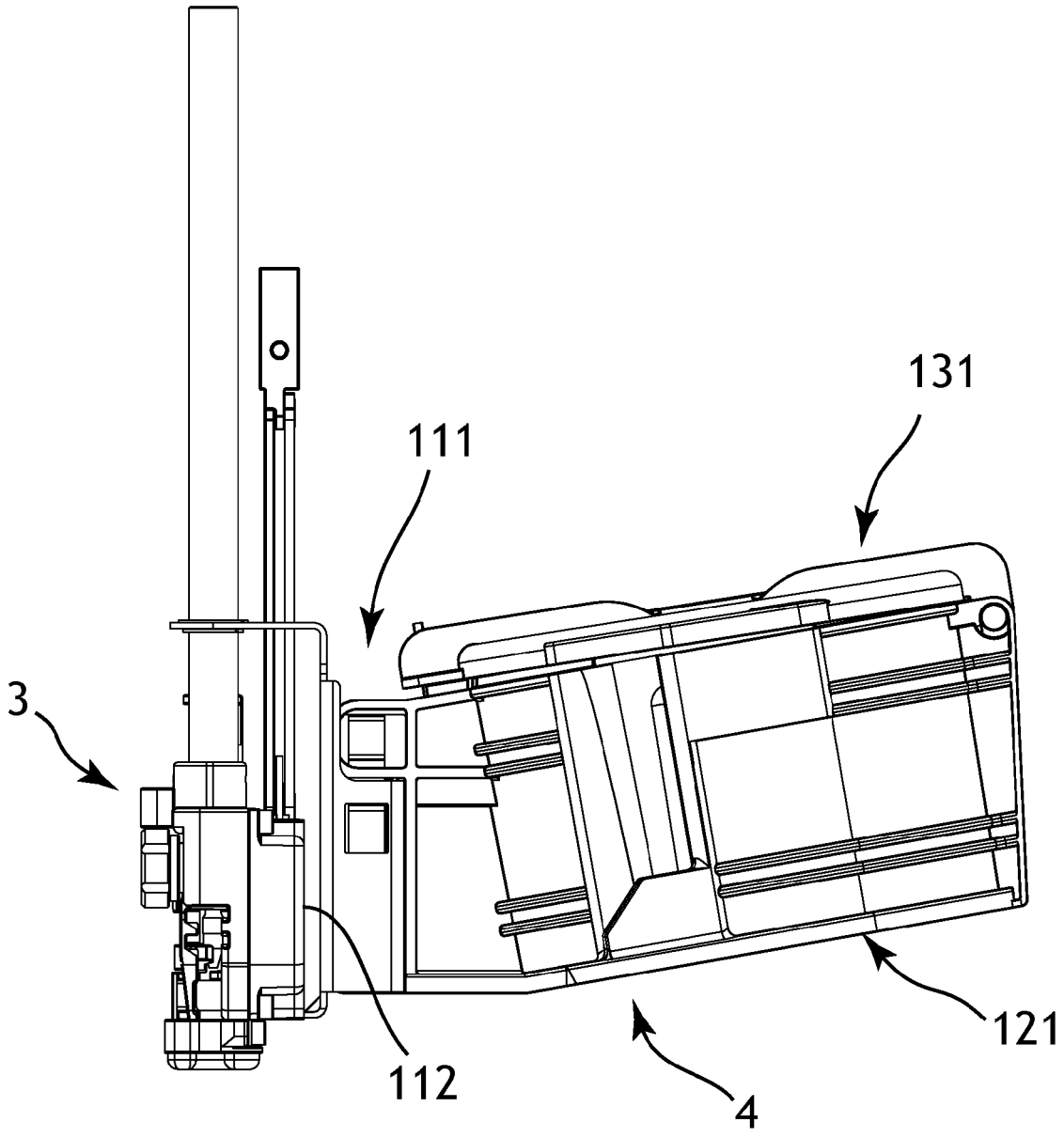
FIG. 25 is a schematic side elevation showing the screw fastener main body unit and a magazine unit according to this example.

As shown in FIG. 24 and FIG. 25, the magazine mounting mechanism section 111 includes a pair of spring plate holding portions 113 which are integrally and vertically arranged on both left and right side portions of, e.g., an iron magazine bracket 112 arranged on the back side of the feeder block 62 in the screw fastener main body unit 3.

The pair of spring plate holding portions 113 symmetrically protruded rearward from both the side portions of the magazine bracket 112 so that an L-like shape (or an inverted L-like shape) is formed in a plane view, and a space between the pair of spring plate holding portions 113 is a region where the magazine unit 4 is attached.

Further, in the vicinity of upper ends of the pair of spring plate holding portions 113, respective fitting hole portions 113*a* are arranged to face each other.

The magazine unit 4 will now be described with reference to FIG. 25 to FIG. 29.

The magazine unit 4 includes a magazine main body 121 which accommodates the screw rope 6 in a wound state and expels the screw rope 3 from a pay-out opening 121*a* toward the screw fastener main body unit 3, and a lid body 131 which is disposed to this magazine main body 121 to be openable/closable by pin coupling of a simple structure, has an upper opening portion covered or exposed, and can be simply attached or detached to or from the magazine main body 121.

Furthermore, a front portion of the magazine main body 121 is detachably arranged in the attaching region of the magazine mounting mechanism section 111.

Figure 26:
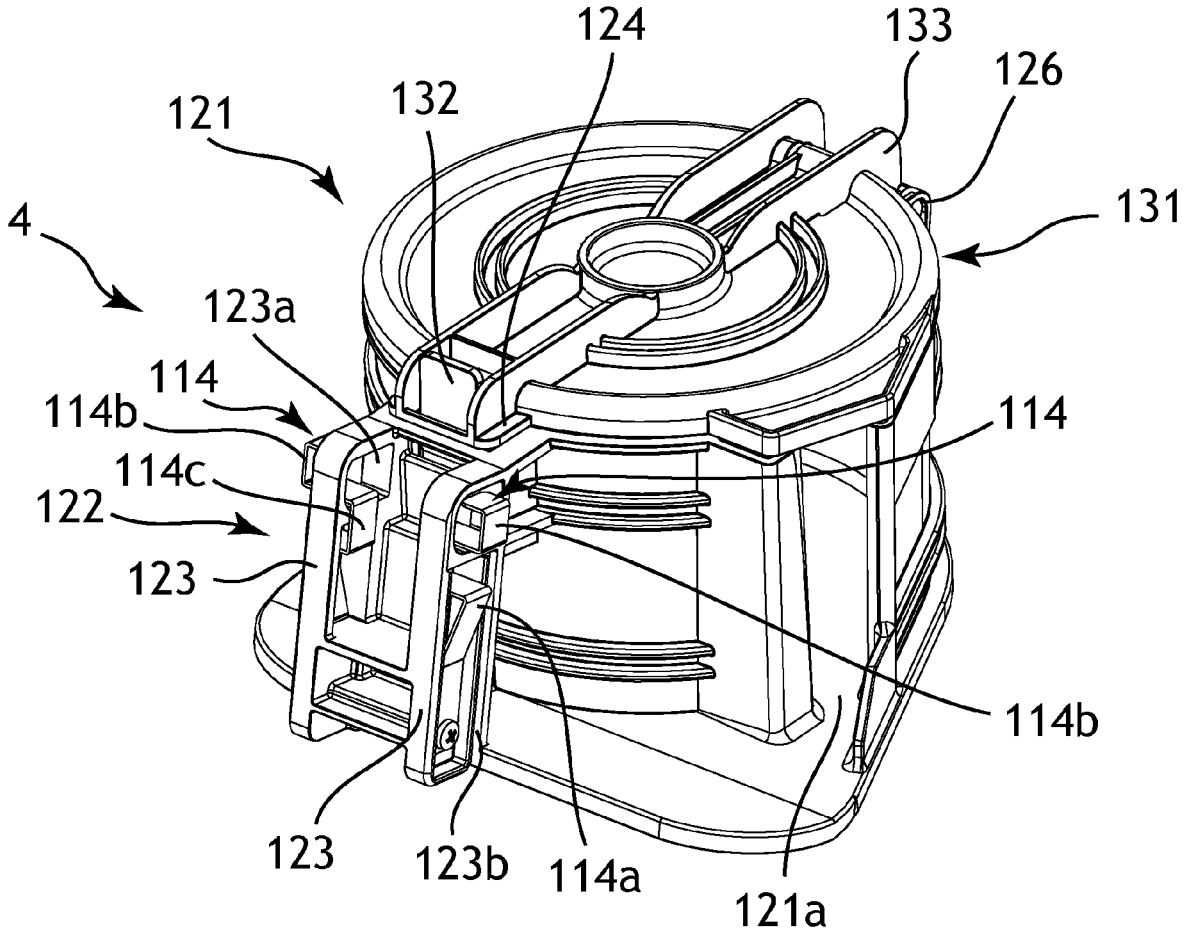
FIG. 26 is a schematic perspective view showing the magazine unit according to this example.
Figure 27:
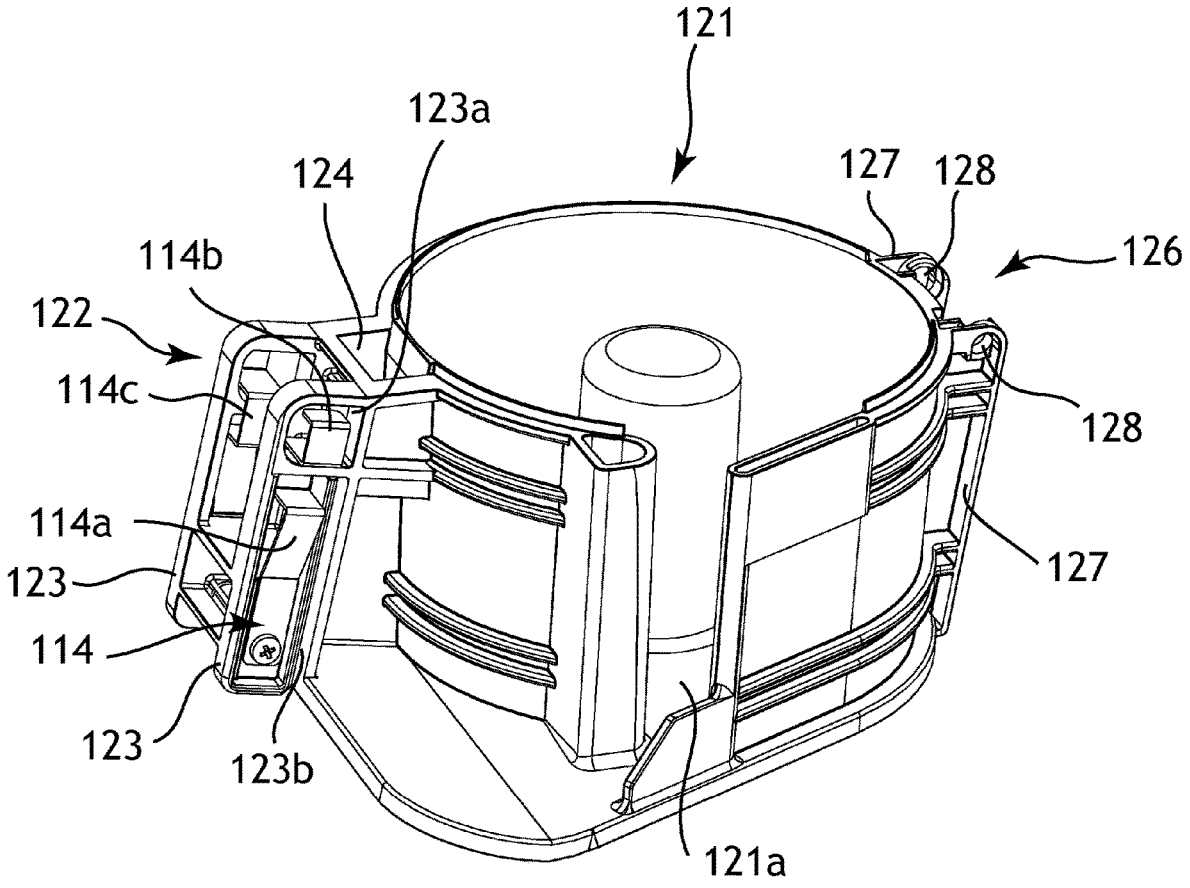
FIG. 27 is a schematic perspective view showing a magazine main body of the magazine unit according to this example.

That is, as shown in FIG. 26 and FIG. 27, an attachment portion 122 which is attached between the pair of spring plate holding portions 113 constituting the magazine mounting mechanism section 111 and is elastically fixed by a later-described pair of spring plates 114 is provided to a front portion of the magazine main body 121.

In the attachment portion 122, a pair of square-frame-like vertical piece portions 123 vertically arranged in parallel between the pair of spring plate holding portions 113 at an interval which enables attachment are integrally provided with the magazine main body 121.

Each of the pair of spring plates 114 is formed into an elastic leaf spring shape, has a lower end portion secured to a position near a lower end portion of an outer surface of each of the vertical piece portions 123 facing the pair of spring plate holding portions 113, and also has an upper side protruded upward from an upper end of each of the pair of spring plate holding portions 113 in a state where these upper sides are spliced on opposed inner surfaces of the pair of spring plate holding portions 113.

Furthermore, the pair of spring plates 114 includes, at their intermediate portions, outwardly bent fitting convex portions 114*a* which can be fitted in the respective fitting hole portions 113*a* and can be protruded sideways from outer wall portions of the spring plate holding portions 113, also includes, at their upper end portions, cranked fitting convex portions 114*b* which are fitted at predetermined positions of the magazine unit 4, and the fitting convex portions 114*a* and the fitting convex portions 114*b* are coupled with each other through coupling piece portions 114*c* respectively.

Moreover, the fitting convex portions 114*b* are formed to further protrude sideways from outer wall surfaces of the spring plate holding portions 113 in the upper portions of the spring plate holding portions 113, respectively.

In respective upper portions of the pair of frame-like vertical piece portions 123, receiving hold portions 123*a* from which the pair of fitting convex portions 114*b* in the magazine mounting mechanism section 111 protrude are provided.

Additionally, engagement grooves 123*b* into which a pair of engagement protruding pieces 113*b* provided at tips of the spring plate holding portions 113 can enter are provided behind the lower sides of the receiving hole portions 123*a*.

Further, the attachment portion 122 of the magazine main body 121 is moved down to the attachment region of the magazine mounting mechanism section 111 from above while engaging the engaging grooves 123*b* of the pair of frame-like vertical piece portions 123 with the pair of engagement protruding pieces 113*b* of the spring plate holding portion 113, and the pair of frame-like vertical piece portions 123 are arranged between the pair of spring plate holding portions 113 in such a manner that the gaps between the pair of fitting convex portions 114*a* and between the pair of fitting convex portions 114*b* of the pair of spring plates 114 are narrowed against their elastic force.

Consequently, the tips of the fitting convex portions 114*a* are fitted into the fitting hole portions 113*a* provided in the pair of spring plate holding portions 113, respectively.

As a result, the attachment portion 122 of the magazine main body 121 can be assuredly supported in the attachment region of the magazine mounting mechanism section 111.

On the other hand, in case of removing the attachment portion 122 of the magazine main body 121 from the attachment region of the magazine mounting mechanism section 111, the magazine main body 121 is lifted up while pressing the respective fitting convex portions 114*b* of the pair of spring plates 114 toward the inner side.

That is, when the respective fitting convex portions 114*b* of the pair of spring plates 114 are pressed toward the inner side by an operation of the operator, the pair of fitting convex portions 114*a* protruding from the upper end edges of the fitting hole portions 113*a* formed in the pair of spring plate holding portions 113 are also inclined toward the inner side, and the fitted state to the fitting hole portions 113*a* is canceled.

Consequently, the attachment portion 122 of the magazine main body 121 can be simply removed from the attachment region of the magazine mounting mechanism section 111 from above.

Adopting the magazine mounting mechanism section 111 and the attachment portion 122 of the magazine main body 121 described above enables realizing simplification of the attaching/detaching operation and improvement in stability in the held state of the magazine main body 121 while enhancing rigidity at the time of attaching/detaching the magazine main body 121 to/from the screw fastener main body unit 3.

A coupling configuration of the magazine main body 121 and the lid body 131 will now be described with reference to FIG. 26 to FIG. 29.

As shown in FIG. 26 and FIG. 27, a lid body receiving hole 124 formed into a square shape is provided on the rear side of the pair of frame-like vertical piece portions 123 in the attachment portion 122 of the magazine main body 121, and a lid body shaft support portion 126 which pivotally supports the lid body 131 by pin coupling to be openable/closable is provided on a rear portion side (the opposite side of the vertical piece portions 123) of the magazine main body 121.

The lid body shaft support portion 126 is constituted by forming a pair of pin holes 128 arranged to horizontally face a pair of pin receiving pieces 127 provided in the vertical arrangement on the rear portion side of the magazine main body 121.

Figure 28:
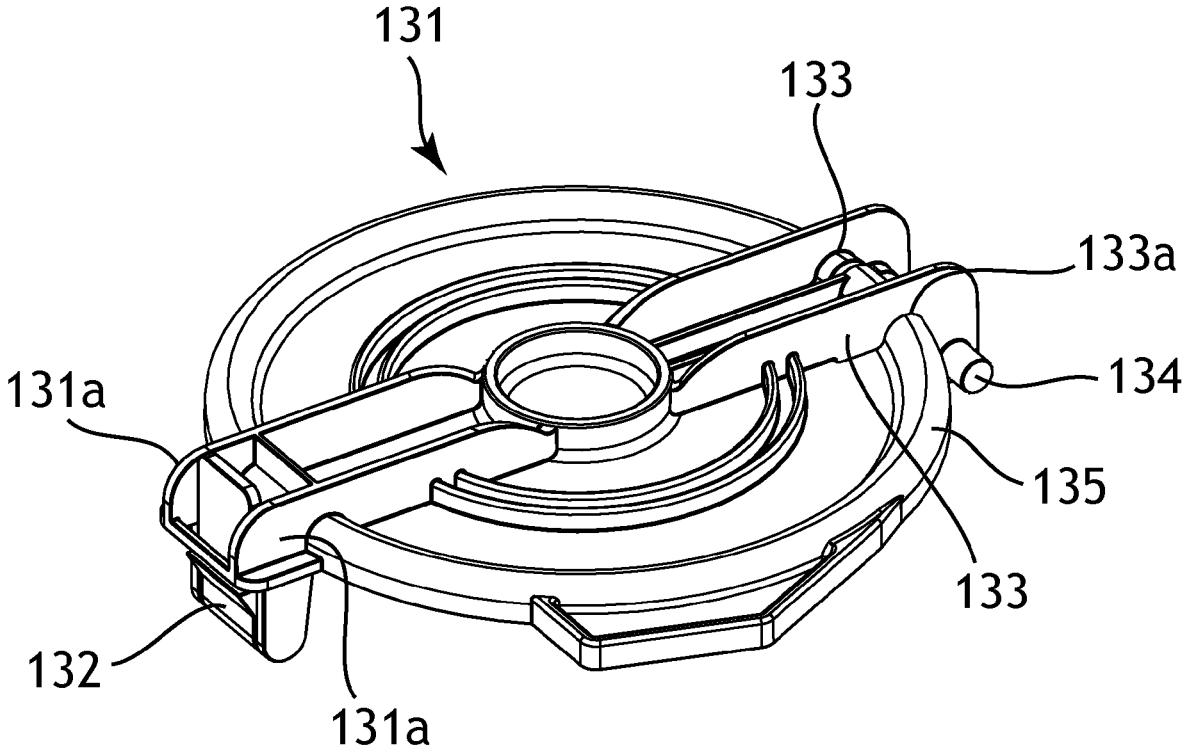
FIG. 28 is a schematic perspective view showing a lid body of the magazine unit according to this example.

On the other hand, as shown in FIG. 26 and FIG. 28, a lid lock body 132 which is turnably supported by a pair of support plates 131*a* and fitted in the lid body receiving hole 124 is provided to a front portion of the lid body 131, and the lid body 131 is locked or unlocked with respect to the magazine main body 121 of the lid body 131 by operating this lid lock body 132.

Figure 29:
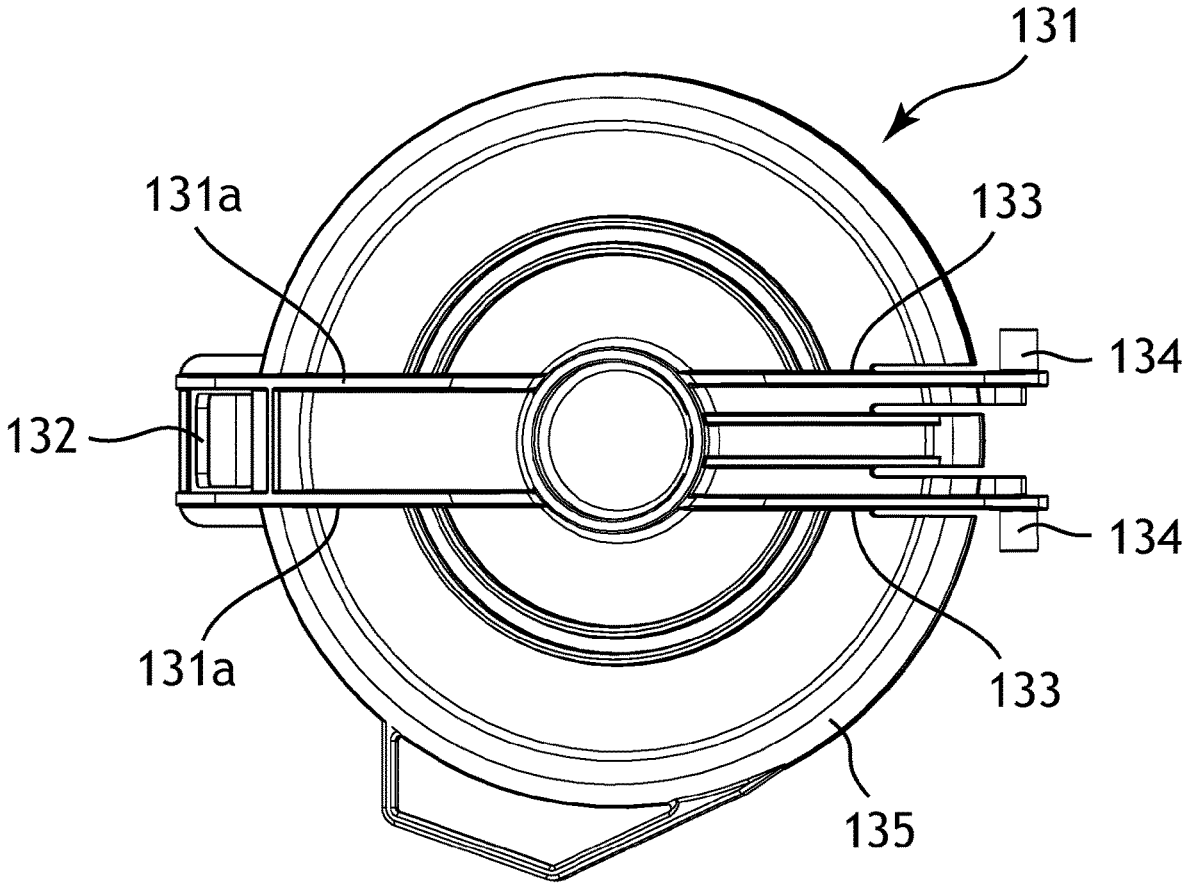
FIG. 29 is a schematic plan view showing the lid body of the magazine unit according to this example.

Further, as shown in FIG. 26, FIG. 28, and FIG. 29, a pair of elastic pin support plates 133 having proximal end sides fixed at a central portion of an upper surface of the lid body 131 and distal end sides displaceable in the horizontal direction are arranged on a rear portion of the lid body 131, and a pair of pins 134 which can be fitted in the pair of pin holes 128 are provided to the pair of pin support plates 133 respectively.

The pair of pin support plates 133 have concave portions 133*a* in their lower portions on the lid body 131 side respectively, and the distal end sides of the respective concave portions 133*a* can be displaced to be widened or narrowed by a gripping operation of the operator's hand while engaging the respective concave portions 133*a* with a protrusion 135 circularly provided on the upper surface of the lid body 131.

According to the pin coupling configuration of the magazine main body 121 and the lid body 131, the lid body 131 can be disposed to the magazine main body 121 to enter the pivotally supported state which enables opening/closing by a simple operation of the operator, namely, griping the distal end sides of the pair of pin support plates 133 with his/her hand, fitting the pair of pins 134 into the pair of pin holes 128 in a state where the gap between the pair of pin support plates 133 on the distal end side is narrowed, and then releasing his/her hand from the pair of pin support plates 133.

Further, in case of detaching the lid body 131 from the magazine main body 121, the detachment can be realized by just performing a simple operation, i.e., gripping the distal end sides of the pair of pin support plates 133 with the operator's hand in the pivotally supported state, narrowing the gap between the pair of pin support plates 133 on the distal end sides, and removing the pair of pins 134 from the pair of pin holes 128, and lifting up the lid body 131 in this state.

It is to be noted that, in the successive screw fastener 1 according to this example, the revolution speed of the bit B can cope with a plurality of types of revolution speeds by rearranging the gears in the rotary drive section 22.

For example, although the number of type of the revolution speed is one, i.e., 2400 rpm/min in a fixed gear structure in the conventional successive screw fastener, the revolution speed of the bit B can cope with five types of revolution speed, i.e., 1200/1800/2400/3000/3500 rpm/min to deal with fastening of a drill screw having a diameter of 6 mm for high-tensile steel to a wood screw having a diameter of 4 mm in the successive screw fastener 1 according to this example, and one successive screw fastener 1 can be widely exploited.

Specifically, a set of the second gear 29, the third gear 30, and the fourth gear 31 in the rotary drive section 22 is changed to respective gears having different numbers of teeth which realize respective rotation speeds, thus realizing a change in revolution speed of the bit B.

INDUSTRIAL APPLICABILITY

The present invention can provide the successive screw fastener which can be extensively applied to a screw fastening operation to a structure material constituting a floor or the like of a truck deck or a floor or the like in a building such as a house, a screw fastening operation to a structure material such as a floor of a ship, and the like, and can widely cope with screws of different sizes by appropriately changing dimensions of the respective elements in the successive screw fastener itself.

REFERENCE SIGNS LIST

1 successive screw fastener
2 grip unit
3 screw fastener main body unit
4 magazine unit
5 handle unit
6 screw rope
7 strip-like member
11 handle cover
12 end cover
13 housing
14*a* lower first cover
14*b* lower second cover
15 block head
15*a* guide pole insertion tube
15*b* guide pole insertion tube
15*c* bit insertion tube
15*d* accommodation hole
16 trigger switch
17 direction lever
18 handle unit insertion opening
19 handle unit lock lever
19*a* cam portion
20 cord holding portion
21*a* guide pole
21*b* guide pole
22 rotary drive section
23 rotary drive source
24 bit rotary drive mechanism section
24*a* bearing
24*b* bearing
24*c* driving shaft
25 drive motor
26 brush
27 stator
28 first gear
29 second gear
30 third gear
31 fourth gear
32 clutch
33 bearing
34 socket
35 sleeve
36 bit adjustment dial
41 outer shaft
41*a* recess
42 inner shaft
42*a* countersink portion
42*b* stopper pin
43 handle block
43*a* countersunk bolt
44*a* insert shaft
44*b* fixing head
44*c* spring
45 handle bar block
46 handle grip
47 handle bar
50 feed lever operation body
51*a* stopper plate
51*b* stopper plate
53 plate mounting block
54 shaft pin
55 stopper roller
61 screw feed mechanism section
62 feeder block
62*a* screw head concave groove
62*b* screw head concave groove
62*c* guide pole receiving portion
62*d* guide pole receiving portion
63 guide cover
63*a* screw head concave groove
63*b* screw head concave groove
64 feed lever
64A lever main body
64*a* stop recessed portion
64*b* inclined face portion
64*c* protruding piece
64*d* support plate portion
65 feed latch
65*a* latch piece
65*b* turning receiving piece
65*c* screw receiving concave portion
66 grip finger
66*a* grip piece
66*b* screw holding concave portion
66*c* link piece
66*d* finger operation piece
67 release lever
67*a* concave portion
68 feed lever pin
69 feed latch pin
70 grip finger pin
71 adjustment block portion
71*a* concave groove
72 circular stage cam
73 screw guide plate portion
74 through hole
75 adjustment dial
75*a* cam contact piece
76 support screw
77 screw guide
78 screw rope cutter
78*a* cutter blade portion
81 handle unit insertion opening cover
82 pin
83 lever spring
91 gap adjustment mechanism section
92 recessed portion
92*a* sliding protruding piece
92*b* central hole
93 pin
101 screw guide position adjustment mechanism section
102 adjusting plate
102*a* engaging irregular portion
102*b* bit hole
102*c* bent piece
103 adjusting block
103*a* engaging irregular portion
104 adjusting lever
104*a* support pin
105 operation piece
105*a* adjusting block operation protruding piece
105*b* fitting tube portion
111 magazine mounting mechanism section
112 magazine bracket

113 spring plate holding portion
113*a* fitting hole portion
113*b* engagement protruding piece
114 spring plate
114*a* fitting convex portion
114*b* fitting convex portion
114*c* coupling piece portion
121 magazine main body
121*a* pay-out opening
122 attachment portion
123 vertical piece portion
123*a* receiving hole portion
123*b* engagement groove
124 lid body receiving hole
126 lid body shaft support portion
127 pin receiving piece
128 pin hole
131 lid body
131*a* support plate
132 lid lock body
133 pin support plate
133*a* concave portion
134 pin
135 protrusion
B bit
S screw

What is claimed is:

1. A successive screw fastener comprising: a grip unit which has a screw fastening bit arranged to protrude from the grip unit and the grip unit rotationally drives the screw fastening bit via a switch operation and a clutch; a screw fastener main body unit which is arranged below the grip unit, supports the grip unit to be upwardly and downwardly movable, arranges a tip of the bit to face a fastening acting position, and fastens a screw at a fastening target position on a lower side; and a magazine unit which is detachably disposed to the screw fastener main body unit, accommodates a screw rope holding many screws at predetermined intervals, and expels the screw rope toward the screw fastener main body unit, the successive screw faster being configured to sequentially guide the respective screws held by the screw rope to the fastening acting position below a tip of the bit in tandem with a rising operation of the grip unit, and successively fasten the respective screws to the fastening target position below the screw fastener main body unit by using rotational force of the bit in tandem with a lowering operation of the grip unit in a rotating state of the bit, wherein the grip unit is configured to include a trigger switch having a direction lever which sets forward rotation and reverse rotation directions of a rotary drive unit which rotationally drives the bit, the screw fastener main body unit comprises:

a gap adjustment mechanism section which changes a gap between a feeder block which guides the screw held by the screw rope to the fastening acting position and a guide cover arranged to face the feeder block on the basis of translation adjustment of the guide cover;

a screw feed mechanism section which enables feeding the screws to the fastening acting position one by one while avoiding interference between a head portion of each screw and the tip of the bit, and enables taking out the screw held by the screw rope from the fastening acting position by an operation of an operator;

a screw guide position adjustment mechanism section which is arranged at a lower end portion of the screw fastener main body unit and adjusts a position of a screw guide arranged to abut on the fastening target position; and a magazine mounting mechanism section having rigidity which is provided on a rear portion side of the screw fastener main body unit, and the magazine unit comprises a magazine main body, which accommodates and expels the screw rope, and further comprises a lid body, which covers the magazine main body, and the magazine main body is attachable to and detachable from the screw fastener main body unit by using elastic force of a spring plate which is arranged in the magazine main body and has spring properties.

2. The successive screw fastener according to claim 1, wherein the screw fastener main body unit comprises a screw rope cutter which cuts the empty screw rope discharged from the screw fastener main body unit.

3. The successive screw fastener according to claim 2, wherein a magazine main body of the magazine unit includes a lid body shaft support portion having a pair of pin holes, and the lid body is attachable to or detachable from the lid body shaft support portion by engaging or disengaging a pair of pins supported by a pair of pin support plates, which are provided on an upper surface of the lid body and displaceable so that their tip sides move closer to or away from each other by a manual operation, into or from a pair of pin holes of the lid body shaft support portion.

4. The successive screw fastener according to claim 1, wherein a magazine main body of the magazine unit includes a lid body shaft support portion having a pair of pin holes, and the lid body is attachable to or detachable from the lid body shaft support portion by engaging or disengaging a pair of pins supported by a pair of pin support plates, which are provided on an upper surface of the lid body and displaceable so that their tip sides move closer to or away from each other by a manual operation, into or from a pair of pin holes of the lid body shaft support portion.

5. The successive screw fastener according to claim 1, wherein a magazine main body of the magazine unit includes a lid body shaft support portion having a pair of pin holes, and the lid body is attachable to or detachable from the lid body shaft support portion by engaging or disengaging a pair of pins supported by a pair of pin support plates, which are provided on an upper surface of the lid body and displaceable so that their tip sides move closer to or away from each other by a manual operation, into or from a pair of pin holes of the lid body shaft support portion.

6. A successive screw fastener comprising: a grip unit which has a screw fastening bit arranged to protrude from the grip unit and the grip unit rotationally drives the screw fastening bit via a switch operation and a clutch; a screw fastener main body unit which is arranged below the grip unit, supports the grip unit to be upwardly and downwardly movable, arranges a tip of the bit to face a fastening acting position, and fastens a screw at a fastening target position on a lower side; a magazine unit which is detachably disposed to the screw fastener main body unit, accommodates a screw rope holding many screws at predetermined intervals, and expels the screw rope toward the screw fastener main body unit; and a handle unit which is detachably disposed to an upper portion of the grip unit to enable adjustment of a protruding height to the grip unit, the successive screw fastener being configured to sequentially guide the respective screws held by the screw rope to the fastening acting position below a tip of the bit in tandem with a rising operation of the grip unit, and successively fasten the respective screws to the fastening target position below the screw fastener main body unit by using rotational force of the bit in tandem with a lowering operation of the grip unit in a rotating state of the bit, wherein the grip unit is configured to include a trigger switch having a direction lever which sets forward rotation and reverse rotation directions of a rotary drive section which rotationally drives the bit, the screw fastener main body unit comprises:

a gap adjustment mechanism section which changes a gap between a feeder block which guides the screw held by the screw rope to the fastening acting position and a guide cover arranged to face the feeder block on the basis of translation adjustment of the guide cover;

a screw feed mechanism section which enables feeding the screws to the fastening acting position one by one while avoiding interference between a head portion of each screw and the tip of the bit, and enables taking out the screw held by the screw rope from the fastening acting position by an operation of an operator;

a screw guide position adjustment mechanism section which is arranged at a lower end portion of the screw fastener main body unit and adjusts a position of a screw guide arranged to abut on the fastening target position; and a magazine mounting mechanism section having rigidity which is provided on a rear portion side of the screw fastener main body unit, the magazine unit comprises a magazine main body, which accommodates and expels the screw rope, and further comprises a lid body, which covers the magazine main body, and the magazine main body is configured to be attachable to and detachable from the screw fastener main body unit by using elastic force of a spring plate which is arranged in the magazine main body and has spring properties, and the handle unit is configured to enable easily adjusting a protruding length of the grip unit from the handle grip to be long or short by a double structure consisting of an outer shaft and an inner shaft.

7. The successive screw fastener according to claim 6, wherein the handle unit is inserted into a handle unit insertion opening having no irregularities which is provided in an upper surface portion of the grip unit, and fixed to the grip unit by a handle unit lock lever provided to the grip unit.

8. The successive screw fastener according to claim 7, wherein a magazine main body of the magazine unit includes a lid body shaft support portion having a pair of pin holes, and the lid body is attachable to or detachable from the lid body shaft support portion by engaging or disengaging a pair of pins supported by a pair of pin support plates, which are provided on an upper surface of the lid body and displaceable so that their tip sides move closer to or away from each other by a manual operation, into or from a pair of pin holes of the lid body shaft support portion.

9. The successive screw fastener according to claim 6, wherein the screw fastener main body unit comprises a screw rope cutter which cuts the empty screw rope discharged from the screw fastener main body unit.

10. The successive screw fastener according to claim 9, wherein the handle unit is inserted into a handle unit insertion opening having no irregularities which is provided in an upper surface portion of the grip unit, and fixed to the grip unit by a handle unit lock lever provided to the grip unit.

11. The successive screw fastener according to claim 10, wherein a magazine main body of the magazine unit includes a lid body shaft support portion having a pair of pin holes, and the lid body is attachable to or detachable from the lid body shaft support portion by engaging or disengaging a pair of pins supported by a pair of pin support plates, which are provided on an upper surface of the lid body and displaceable so that their tip sides move closer to or away from each other by a manual operation, into or from a pair of pin holes of the lid body shaft support portion.

12. The successive screw fastener according to claim 9, wherein a magazine main body of the magazine unit includes a lid body shaft support portion having a pair of pin holes, and the lid body is attachable to or detachable from the lid body shaft support portion by engaging or disengaging a pair of pins supported by a pair of pin support plates, which are provided on an upper surface of the lid body and displaceable so that their tip sides move closer to or away from each other by a manual operation, into or from a pair of pin holes of the lid body shaft support portion.

13. The successive screw fastener according to claim 6, wherein a magazine main body of the magazine unit includes a lid body shaft support portion having a pair of pin holes, and the lid body is attachable to or detachable from the lid body shaft support portion by engaging or disengaging a pair of pins supported by a pair of pin support plates, which are provided on an upper surface of the lid body and displaceable so that their tip sides move closer to or away from each other by a manual operation, into or from a pair of pin holes of the lid body shaft support portion.

14. A successive screw fastener comprising: a grip unit which has a screw fastening bit arranged to protrude from the grip unit and the grip unit rotationally drives the screw fastening bit via a switch operation and a clutch; a screw fastener main body unit which is arranged below the grip unit, supports the grip unit to be upwardly and downwardly movable, arranges a tip of the bit to face a fastening acting position, and fastens a screw at a fastening target position on a lower side; a magazine unit which is detachably disposed to the screw fastener main body unit, accommodates a screw rope holding many screws at predetermined intervals, and expels the screw rope toward the screw fastener main body unit; and a handle unit which is detachably disposed to an upper portion of the grip unit to enable adjustment of a protruding height to the grip unit, the successive screw fastener being configured to sequentially guide the respective screws held by the screw rope to the fastening acting position below a tip of the bit in tandem with a rising operation of the grip unit, and successively fasten the respective screws to the fastening target position below the screw fastener main body unit by using rotational force of the bit in tandem with a lowering operation of the grip unit in a rotating state of the bit, wherein the grip unit is configured to include a trigger switch having a direction lever which sets forward rotation and reverse rotation directions of a rotary drive section which rotationally drives the bit, the screw fastener main body unit comprises:

a gap adjustment mechanism section which changes a gap between a feeder block which guides the screw held by the screw rope to the fastening acting position and a guide cover arranged to face the feeder block on the basis of translation adjustment of the guide cover;

a screw feed mechanism section which comprises a feed lever operation body interlocked with lowering and rising of the grip unit, a feed lever which operates in response to lowering and rising of the feed lever operation body, a feed latch for screw feeding turnably supported by the feed lever, a turnable grip finger which locks the screw to face a fastening acting position, and a release lever which constitutes a single link structure interlocked with the feed latch and the grip finger, enables feeding the screws to the fastening acting position one by one while avoiding interference between a head portion of each screw and the tip of the bit, and interlocks the grip finger and the feed latch via the release lever to enable taking out the screw held by the screw rope from the fastening acting position by an operation of an operator;

a screw guide position adjustment mechanism section which is arranged at a lower end portion of the screw fastener main body unit and adjusts a position of a screw guide arranged to abut on the fastening target position; and a magazine mounting mechanism section having rigidity which is provided on a rear portion side of the screw fastener main body unit, the magazine unit comprises a magazine main body, which accommodates and expels the screw rope, and further comprises a lid body, which covers the magazine main body, is arranged in the magazine main body, and has spring properties, the lid body being configured to be attachable to and detachable from a lid body shaft support portion of the magazine main body by pin coupling, and the handle unit has a double structure consisting of an outer shaft and an inner shaft, the outer shaft being configured to enable adjusting its position to the grip unit, configured to be attachable to and detachable from the screw fastener main body unit by using elastic force of a spring plate, and configured to be locked, the inner shaft being configured to enable adjusting its position to an outer shaft and configured to be locked, and a protruding length of a handle grip from the grip unit being adjustable to be increased or reduced.

15. The successive screw fastener according to claim 14, wherein the screw fastener main body unit comprises a screw rope cutter which cuts the empty screw rope discharged from the screw fastener main body unit.

16. The successive screw fastener according to claim 15, wherein the handle unit is inserted into a handle unit insertion opening having no irregularities which is provided in an upper surface portion of the grip unit, and fixed to the grip unit by a handle unit lock lever provided to the grip unit.

17. The successive screw fastener according to claim 16, wherein a magazine main body of the magazine unit includes a lid body shaft support portion having a pair of pin holes, and the lid body is attachable to or detachable from the lid body shaft support portion by engaging or disengaging a pair of pins supported by a pair of pin support plates, which are provided on an upper surface of the lid body and displaceable so that their tip sides move closer to or away from each other by a manual operation, into or from a pair of pin holes of the lid body shaft support portion.

18. The successive screw fastener according to claim 15, wherein a magazine main body of the magazine unit includes a lid body shaft support portion having a pair of pin holes, and the lid body is attachable to or detachable from the lid body shaft support portion by engaging or disengaging a pair of pins supported by a pair of pin support plates, which are provided on an upper surface of the lid body and displaceable so that their tip sides move closer to or away from each other by a manual operation, into or from a pair of pin holes of the lid body shaft support portion.

19. The successive screw fastener according to claim 14, wherein the handle unit is inserted into a handle unit insertion opening having no irregularities which is provided in an upper surface portion of the grip unit, and fixed to the grip unit by a handle unit lock lever provided to the grip unit.

20. The successive screw fastener according to claim 19, wherein a magazine main body of the magazine unit includes a lid body shaft support portion having a pair of pin holes, and the lid body is attachable to or detachable from the lid body shaft support portion by engaging or disengaging a pair of pins supported by a pair of pin support plates, which are provided on an upper surface of the lid body and displaceable so that their tip sides move closer to or away from each other by a manual operation, into or from a pair of pin holes of the lid body shaft support portion.

21. The successive screw fastener according to claim 14, wherein a magazine main body of the magazine unit includes a lid body shaft support portion having a pair of pin holes, and the lid body is attachable to or detachable from the lid body shaft support portion by engaging or disengaging a pair of pins supported by a pair of pin support plates, which are provided on an upper surface of the lid body and displaceable so that their tip sides move closer to or away from each other by a manual operation, into or from a pair of pin holes of the lid body shaft support portion.

* * * * *